US007384120B2

(12) United States Patent
Konno

(10) Patent No.: US 7,384,120 B2
(45) Date of Patent: Jun. 10, 2008

(54) INKJET RECORDING METHOD AND INKJET RECORDING APPARATUS

(75) Inventor: Masaaki Konno, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/729,805

(22) Filed: Mar. 30, 2007

(65) Prior Publication Data

US 2007/0229591 A1 Oct. 4, 2007

(30) Foreign Application Priority Data

Mar. 31, 2006 (JP) ..... 2006-100305
Mar. 31, 2006 (JP) ..... 2006-100306

(51) Int. Cl.
*B41J 2/165* (2006.01)

(52) U.S. Cl. ..... 347/30; 347/43; 347/24

(58) Field of Classification Search ..... 347/24, 347/30, 35, 43, 95, 100
See application file for complete search history.

(56) References Cited

U.S. PATENT DOCUMENTS 6,481,824 B1 * 11/2002 Hayakawa et al. ..... 347/24
2004/0056921 A1 3/2004 Nakagawa et al.
2005/0275681 A1 * 12/2005 Nakagawa et al. ..... 347/30
2007/0252866 A1 * 11/2007 Kudo et al. ..... 347/30

FOREIGN PATENT DOCUMENTS

JP 2004-98626 A 4/2004

* cited by examiner

*Primary Examiner*—Lamson D. Nguyen
(74) *Attorney, Agent, or Firm*—Birch, Stewart, Kolasch & Birch, LLP

(57) ABSTRACT

The inkjet recording apparatus has a recording head including: large nozzles which eject ink containing pigment particles serving as a coloring material; small nozzles which eject the ink; and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that number of ejections of the ink from the large nozzles is greater than number of ejections of the ink from the small nozzles.

18 Claims, 15 Drawing Sheets

FIG.9

| $D_{95}$ OF PIGMENT INK (μm) | PURGING CONTROL | OCCURRENCE OF EJECTION FAILURES | LINE DEVIATIONS | OVERALL EVALUATION | |
|---|---|---|---|---|---|
| 130 | CONTROL 1 | good | good | very good | PRESENT EMBODIMENT 1 |
| 130 | CONTROL 2 | good | good | very good | PRESENT EMBODIMENT 2 |
| 150 | CONTROL 1 | good | good | very good | PRESENT EMBODIMENT 3 |
| 150 | CONTROL 2 | good | good | very good | PRESENT EMBODIMENT 4 |
| 130 | CONTROL 3 | average | poor | poor | COMPARATIVE EXAMPLE 1 |
| 150 | CONTROL 3 | average | poor | poor | COMPARATIVE EXAMPLE 2 |
| 160 | CONTROL 1 | poor | poor | poor | COMPARATIVE EXAMPLE 3 |
| 160 | CONTROL 2 | poor | poor | poor | COMPARATIVE EXAMPLE 4 |
| 160 | CONTROL 3 | poor | poor | poor | COMPARATIVE EXAMPLE 5 |

FIG.12

| INK ($D_{95}$) | PURGING CONTROL | OCCURRENCE OF EJECTION FAILURES | LINE DEVIATIONS | OVERALL EVALUATION |
|---|---|---|---|---|
| 110 | CONTROL A, B | good | good | very good |
| 130 | CONTROL A, B | good | good | very good |
| 150 | CONTROL A, B | good | good | very good |
| 160 | CONTROL A, B | poor | poor | poor |

FIG.13

| INK ($D_{95}$) | PURGING CONTROL | OCCURRENCE OF EJECTION FAILURES | LINE DEVIATIONS | OVERALL EVALUATION |
|---|---|---|---|---|
| 100 | CONTROL C | good | good | very good |
| 110 | CONTROL C | good | good | very good |
| 130 | CONTROL C | average | poor | poor |
| 150 | CONTROL C | average | poor | poor |
| 160 | CONTROL C | poor | poor | poor |

INKJET RECORDING METHOD AND INKJET RECORDING APPARATUS

BACKGROUND OF THE INVENTION

1. Field of the Invention

The present invention relates to an inkjet recording method and an inkjet recording apparatus, and more particularly, to a so-called "shuttle scanning" (serial scanning) type of inkjet recording method and apparatus in which an image is recorded using a pigment-based ink while moving an inkjet head reciprocally in a direction perpendicular to the conveyance direction of the recording medium.

2. Description of the Related Art

Conventionally, an inkjet recording apparatus (inkjet printer) is known, which comprises an inkjet head (ink ejection head) having an arrangement of a plurality of nozzles (ink ejection ports) and which forms images on a recording medium by ejecting ink in the form of liquid droplets from the nozzles toward the recording medium while causing the inkjet head and the recording medium to move relatively with respect to each other.

Various methods are known conventionally as ink ejection methods for an inkjet recording apparatus of this kind. For example, one known method is a piezoelectric method, where the volume of a pressure chamber (ink chamber) is changed by causing a vibration plate forming a portion of the pressure chamber to deform due to deformation of a piezoelectric element (piezoelectric ceramic), ink being introduced into the pressure chamber from an ink supply passage when the volume is increased, and the ink inside the pressure chamber being ejected as a droplet from the nozzle when the volume of the pressure chamber is reduced. Another known method is a thermal inkjet method where ink is heated to generate a bubble in the ink, and ink is then ejected by means of the expansive energy created as the bubble grows.

In an image forming apparatus having an ink ejection head such as an inkjet recording apparatus, ink is supplied to an ink ejection head via an ink supply channel from an ink tank which stores ink, and this ink is ejected by one of the various ejection methods described above. However, it is necessary that ink is ejected stably in such a manner that factors, such as the ink ejection volume, the ejection velocity, the ejection direction, and the shape (volume) of the ejected ink, conform to uniform values at all times.

However, during printing, the nozzles of the ink ejection head are filled with ink at all times, in order that printing can be performed as soon as a printing instruction is issued. Therefore, the ink in the nozzles is exposed to the air, and the ink in nozzles which do not perform ejection for a long period of time dries, the viscosity of the ink increases, and nozzle blockages may occur. Increased viscosity of this kind in the ink meniscus of the nozzles may be a cause of ink ejection failures. Furthermore, there is a possibility that foreign matter, such as dust, and air bubbles which have entered inside the ink supply channel may become trapped and block the supply of ink, leading to the occurrence of ejection defects.

Therefore, conventionally, in response to increased viscosity of the ink in the meniscus region in the nozzles, which can be a cause of ink ejection defects and ink ejection failures, restoration processing has been carried out by purging (dummy ejection or preliminary ejection) or suctioning, in order to expel this ink of increased viscosity from the head, forcibly, at periodic intervals.

In suction-based restoration processing of this kind, the nozzle surface of the inkjet head is covered with a cap and the ink inside the inkjet head is suctioned forcibly by means of a pump, but the ink expelled into the cap by suctioning remains on the nozzle surface immediately after suctioning and may flow in reverse back into the inkjet head. Therefore, a preliminary ejection is carried out after performing a suctioning restoration process.

For example, Japanese Patent Application Publication No. 2004-98626 discloses an inkjet recording apparatus which forms images by using an inkjet head having at least two types of nozzles which eject different ink ejection volumes, including a row of large nozzles and a row of small nozzles. In this apparatus, the amount of floating mist is reduced and the time required for preliminary ejection after suctioning is shortened, by making the number of ejections performed by the large nozzles greater than the number of ejections performed by the small nozzles, or by increasing the ejection frequency of the large nozzles, when preliminary ejection is carried out after suctioning the meniscus.

However, Japanese Patent Application Publication No. 2004-98626 discloses technology relating to the control of preliminary ejection performed by large nozzles and small nozzles after a suctioning restoration process, with the aim of reducing the time required for preliminary ejection after suctioning and preventing the generation of floating mist during preliminary ejection, but it makes no disclosure with respect to purging (preliminary ejection) during a recording scan; in particular when a pigment-based ink is used, there is a problem in controlling preliminary ejection carried out during recording in order to improve ejection stability.

SUMMARY OF THE INVENTION

The present invention was contrived in the view of the foregoing circumstances, an object thereof being to provide an inkjet recording method and an inkjet recording apparatus which make it possible to shorten the time of preliminary ejection, prevent the occurrence of floating mist, stabilize ejection, prevent ejection failures, or ensure stable high-quality printing and good reliability.

The present invention is directed to an inkjet recording apparatus comprising a recording head including: large nozzles which eject ink containing pigment particles serving as a coloring material; small nozzles which eject the ink; and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that number of ejections of the ink from the large nozzles is greater than number of ejections of the ink from the small nozzles.

In this aspect of the present invention, it is possible to effectively expel ink of degraded quality (e.g., ink of increased viscosity or ink containing air bubbles) inside the recording head, and hence improved ejection stability and improved prevention of ejection failures can be achieved.

The present invention is also directed to an inkjet recording apparatus comprising a recording head including: large nozzles which eject ink containing pigment particles serving as a coloring material; small nozzles which eject the ink; and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that the large nozzles eject the ink that is unrelated to the image recording before the small nozzles eject the ink that is unrelated to the image recording.

In this aspect of the present invention, it is possible to effectively expel ink of degraded quality inside the recording head, and hence improved ejection stability and improved prevention of ejection failures can be achieved.

The present invention is also directed to an inkjet recording apparatus comprising a recording head including: large nozzles which eject ink containing pigment particles serving as a coloring material; small nozzles which eject the ink; and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that a frequency of ejections of the ink from the large nozzles is higher than a frequency of ejections of the ink from the small nozzles.

In this aspect of the present invention, it is possible to effectively expel ink of degraded quality inside the recording head, and hence improved ejection stability and improved prevention of ejection failures can be achieved.

Preferably, the inkjet recording apparatus further comprises a suctioning device which is provided at a particular position outside the region for the image recording and forcibly suctions the ink inside the recording head, wherein, after the suctioning device suctions the ink inside the recording head, the large nozzles and the small nozzles eject the ink that is unrelated to the image recording.

In this aspect of the present invention, even if a suctioning operation is carried out, it is possible to achieve improved ejection stability and improved prevention of ejection failures.

The present invention is also directed to an inkjet recording method comprising the step of moving a recording head including large nozzles which eject ink containing pigment particles serving as a coloring material, small nozzles which eject the ink, and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that number of ejections of the ink from the large nozzles is greater than number of ejections of the ink from the small nozzles.

In this aspect of the present invention, it is possible to effectively expel ink of degraded quality inside the recording head, and hence improved ejection stability and improved prevention of ejection failures can be achieved.

The present invention is also directed to an inkjet recording method comprising the step of moving a recording head including large nozzles which eject ink containing pigment particles serving as a coloring material, small nozzles which eject the ink, and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that the large nozzles eject the ink that is unrelated to the image recording before the small nozzles eject the ink that is unrelated to the image recording.

In this aspect of the present invention, it is possible to effectively expel ink inside the recording head, and hence improved ejection stability and improved prevention of ejection failures can be achieved.

The present invention is also directed to an inkjet recording method comprising the step of moving a recording head including large nozzles which eject ink containing pigment particles serving as a coloring material, small nozzles which eject the ink, and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that a frequency of ejections of the ink from the large nozzles is higher than a frequency of ejections of the ink from the small nozzles.

In this aspect of the present invention, it is possible to effectively expel ink of degraded quality inside the recording head, and hence improved ejection stability and improved prevention of ejection failures can be achieved.

Preferably, after the ink inside the recording head is suctioned forcibly at a particular position outside the region for the image recording, the large nozzles and the small nozzles eject the ink that is unrelated to the image recording.

In this aspect of the present invention, even if a suctioning operation is carried out, it is possible to achieve improved ejection stability and improved prevention of ejection failures.

The present invention is also directed to an inkjet recording apparatus comprising: a recording head including large nozzles which eject ink containing pigment particles serving as a coloring material, small nozzles which eject the ink, and a common ink flow channel which is connected to the large nozzles and the small nozzles; and an ink type determination unit which determines a type of the ink, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; and when an ink ejection process in which the large nozzles and the small nozzles eject the ink that is unrelated to the image recording is performed at a particular timing in a process of the image recording and at a particular position outside a region for the image recording, ejections of the ink from the large nozzles and ejections of the ink from the small nozzles are controlled in such a manner that at least one of number of ejections of the ink from the large nozzles, number of ejections of the ink from the small nozzles, sequence of the ejections of the ink from the large nozzles and the small nozzles, and a frequency of the ejections of the ink from the large nozzles and the small nozzles is adjusted in accordance with the type of the ink determined by the ink type determination unit.

In this aspect of the present invention, it is possible to refresh the old ink inside the common liquid chamber, effectively, during preliminary ejection, and hence improved ejection stability and improved prevention of ejection failures can be achieved, thus making it possible to ensure stable high-quality printing and good reliability.

Preferably, the type of the ink determined by the ink type determination unit is categorized according to particle size distribution of the pigment particles which are contained in the ink and serve as a coloring material; and when the ink ejection process in which the large nozzles and the small nozzles eject the ink that is unrelated to the image recording is performed at the particular timing in the process of the image recording and at the particular position outside the region for the image recording, at least one of the number of ejections of the ink from the large nozzles, the number of ejections of the ink from the small nozzles, the sequence of the ejections of the ink from the large nozzles and the small nozzles, and the frequency of the ejections of the ink from the large nozzles and the small nozzles is adjusted in accordance with the particle size distribution of the pigment particles.

In this aspect of the present invention, even in the case of pigment-based inks having different particle size distributions, it is possible to refresh old ink inside the common liquid chamber effectively during preliminary ejection, by means of a method that is suited to the ink, and hence improved ejection stability and prevention of ejection failures can be achieved, thus making it possible to ensure stable high-quality printing and good reliability.

Preferably, when the ink ejection process in which the large nozzles and the small nozzles eject the ink that is unrelated to the image recording is performed at the particular timing in the process of the image recording and at the particular position outside the region for the image recording, in a case where the pigment particles having a particle diameter of not less than 110 nm account for not more than 5 volume percent of the pigment particles dispersed in the ink, the ejections of the ink from the large nozzles and the ejections of the ink from the small nozzles are performed simultaneously; and in a case where the pigment particles having a particle diameter of not less than 110 nm account for more than 5 volume percent of the pigment particles dispersed in the ink and the pigment particles having a particle diameter of not less than 150 nm is not more than 5 volume percent of the pigment particles dispersed in the ink, the ejections of the ink from the large nozzles and the ejections of the ink from the small nozzles are controlled in accordance with at least one of following manners: a manner in which the number of ejections of the ink from the large nozzles is greater than the number of ejections of the ink from the small nozzles; a manner in which the large nozzles eject the ink that is unrelated to the image recording before the small nozzles eject the ink that is unrelated to the image recording; and a manner in which the frequency of ejections of the ink from the large nozzles is higher than the frequency of ejections of the ink from the small nozzles.

In this aspect of the present invention, improved ejection stability and prevention of ejection failures can be achieved in respect of the small nozzles in particular, and therefore stable high-quality printing can be achieved and good reliability can be ensured.

The present invention is also directed to an inkjet recording method comprising the step of moving a recording head including large nozzles which eject ink containing pigment particles serving as a coloring material, small nozzles which eject the ink, and a common ink flow channel which is connected to the large nozzles and the small nozzles, wherein: a volume of the ink ejected from each of the large nozzles is different from a volume of the ink ejected from each of the small nozzles; the large nozzles and the small nozzles eject the ink to perform image recording on a recording medium in terms of one direction or both directions while the recording head is moved bi-directionally in a direction substantially perpendicular to a conveyance direction of the recording medium; and when an ink ejection process in which the large nozzles and the small nozzles eject the ink that is unrelated to the image recording is performed at a particular timing in a process of the image recording and at a particular position outside a region for the image recording, a type of the ink determined is determined and ejections of the ink from the large nozzles and ejections of the ink from the small nozzles are controlled in such a manner that at least one of number of ejections of the ink from the large nozzles, number of ejections of the ink from the small nozzles, sequence of the ejections of the ink from the large nozzles and the small nozzles, and a frequency of the ejections of the ink from the large nozzles and the small nozzles is adjusted in accordance with the determined type of the ink.

In this aspect of the present invention, it is possible to refresh the old ink inside the common liquid chamber, effectively, during preliminary ejection, and hence improved ejection stability and improved prevention of ejection failures can be achieved, thus making it possible to ensure stable high-quality printing and good reliability.

Preferably, the type of the ink is categorized according to particle size distribution of the pigment particles which are contained in the ink and serve as a coloring material; and when the ink ejection process in which the large nozzles and the small nozzles eject the ink that is unrelated to the image recording is performed at the particular timing in the process of the image recording and at the particular position outside the region for the image recording, at least one of the number of ejections of the ink from the large nozzles, the number of ejections of the ink from the small nozzles, the sequence of the ejections of the ink from the large nozzles and the small nozzles, and the frequency of the ejections of the ink from the large nozzles and the small nozzles is adjusted in accordance with the particle size distribution of the pigment particles.

In this aspect of the present invention, even in the case of pigment-based inks having different particle size distributions, it is possible to refresh old ink inside the common liquid chamber effectively during preliminary ejection, by means of a method that is suited to the ink, and hence improved ejection stability and prevention of ejection failures can be achieved, thus making it possible to ensure stable high-quality printing and good reliability.

Preferably, when the ink ejection process in which the large nozzles and the small nozzles eject the ink that is unrelated to the image recording is performed at the particular timing in the process of the image recording and at the particular position outside the region for the image recording, in a case where the pigment particles having a particle diameter of not less than 110 nm account for not more than 5 volume percent of the pigment particles dispersed in the ink, the ejections of the ink from the large nozzles and the ejections of the ink from the small nozzles are performed simultaneously; and in a case where the pigment particles having a particle diameter of not less than 110 nm account for more than 5 volume percent of the pigment particles dispersed in the ink and the pigment particles having a particle diameter of not less than 150 nm is not more than 5 volume percent of the pigment particles dispersed in the ink, the ejections of the ink from the large nozzles and the ejections of the ink from the small nozzles are controlled in accordance with at least one of following manners: a manner in which the number of ejections of the ink from the large nozzles is greater than the number of ejections of the ink from the small nozzles; a manner in which the large nozzles eject the ink that is unrelated to the image recording before the small nozzles eject the ink that is unrelated to the image recording; and a manner in which the frequency of ejections of the ink from the large nozzles is higher than the frequency of ejections of the ink from the small nozzles.

In this aspect of the present invention, improved ejection stability and prevention of ejection failures can be achieved in respect of the small nozzles in particular, and therefore stable high-quality printing can be achieved and good reliability can be ensured.

As described above, according to the present invention, it is possible effectively to expel ink of degraded quality inside the recording head, and hence improved ejection stability and improved prevention of ejection failures can be achieved. Furthermore, it is possible to refresh the old ink inside the common liquid chamber, effectively, during preliminary ejection, and hence improved ejection stability and improved prevention of ejection failures can be achieved, thus making it possible to ensure stable high-quality printing and good reliability.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 2A and 2B are plan diagrams of recording heads; wherein FIG. 2A illustrates an example of a recording head in a case of recording in one direction only, and FIG. 2B illustrates an example of a recording head in a case of recording in two directions;

FIGS. 3A and 3B are plan diagrams showing examples of a nozzle arrangement of the recording head shown in FIG. 2A; wherein FIG. 3A shows a head where large nozzles and small nozzles are disposed respectively in rows; and FIG. 3B shows a head where large nozzles and small nozzles are disposed alternatively in the same row;

FIG. 9 is an illustrative diagram showing the results of evaluation experiments using a pigment-based ink;

FIG. 12 is an illustrative diagram showing the results of evaluation experiments using a pigment-based ink;

FIG. 13 is a further illustrative diagram showing the results of evaluation experiments using a pigment-based ink;

DETAILED DESCRIPTION OF THE PREFERRED EMBODIMENTS

Figure 1:
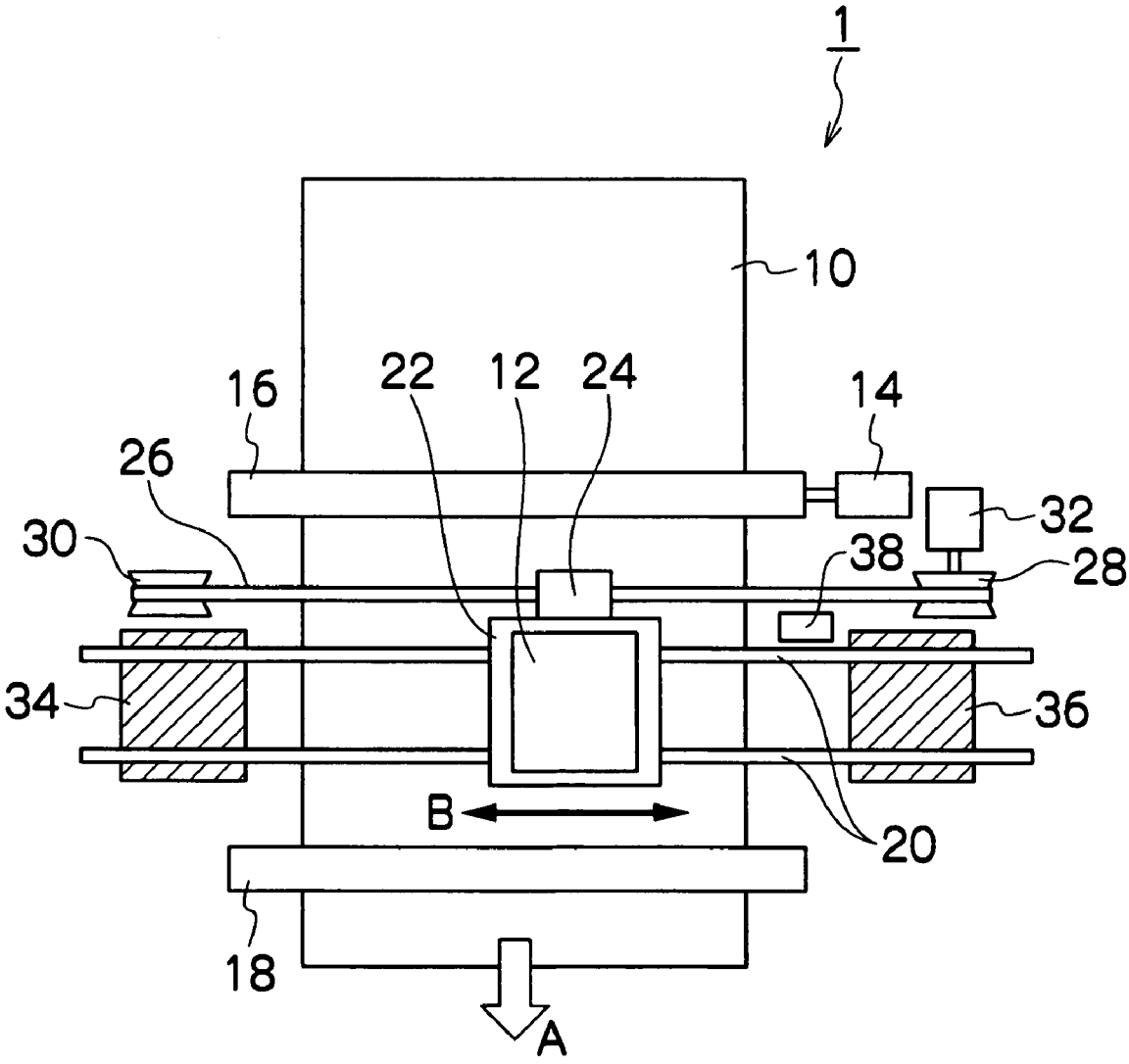
FIG. 1 is a general compositional diagram showing the principal part of an inkjet recording apparatus of one embodiment relating to the present invention.

FIG. 1 is a plan diagram showing the general composition of the principal part of one embodiment of an inkjet recording apparatus relating to the present invention.

As shown in FIG. 1, the inkjet recording apparatus 1 according to the present embodiment is a shuttle scanning (serial scanning) type of image recording apparatus which records images by bi-directionally moving (reciprocally moving) a recording head 12, in a direction (indicated by the arrow B in FIG. 1) which is substantially perpendicular to the conveyance direction of the recording paper 10 (indicated by arrow A in FIG. 1).

The recording paper 10 is supplied by a paper supply roller 16 driven by a paper supply motor 14, such as a stepping motor, for example, to a position below the recording head 12. The recording paper 10 is conveyed in the direction indicated by the arrow A in FIG. 1 (the sub-scanning direction), while being supported and kept flat, by a paper restricting roller 18 which is disposed in a position opposing the paper supply roller 16, on the other side of the recording head 12 from same (i.e., across the recording head 12 from the paper supply roller 16). In this case, in order to improve the flatness of the recording paper 10, it is desirable that a platen which supports the recording paper 10 from the lower side should be provided between the paper supply roller 16 and the paper restricting roller 18.

The recording head 12 is mounted on a carriage 22 which is capable of moving back and forth reciprocally in the direction indicated by the arrow B in FIG. 1, along guide shafts 20 which are disposed so as to span over the recording paper 10 in the breadthways direction of the paper, which is a direction substantially perpendicular to the conveyance direction of the recording paper 10.

The carriage 22 is fixed to a timing belt 26 by means of a belt fixing unit 24. The timing belt 26 is spanned between a drive pulley 28 and an idle pulley 30, and the drive pulley 28 is driven by a main scanning motor 32. When the main scanning motor 32 is driven, the drive pulley 28 rotates, and this causes the timing belt 26 to rotate, which in turn causes the carriage 22 to move reciprocally in the direction indicated by arrow B in FIG. 1.

Purge receptacles (caps) 34 and 36 are provided respectively outside the printing region, on either end of the recording paper 10 in the breadthways direction. In particular, the purge receptacle 36 provided outside the printing region to the right-hand side of the recording paper 10 in FIG. 1 is described in detail below, and it constitutes a restoration mechanism in conjunction with the suctioning device. During maintenance, the carriage 22 is moved to the positions of these purge receptacles 34 and 36, and maintenance of the recording head 12, such as purge (preliminary ejection) and suctioning, is carried out. Furthermore, a position sensor 38 is provided in order to determine that the recording head 12 is disposed in the position of the purge receptacle 36 constituting the restoration mechanism (home position).

The recording head 12 is mounted on a carriage 22. With the movement of the carriage 22, the recording head 12 scans (moves) over the recording paper 10 in both directions in the breadthways direction of the paper, as indicated by the arrow B in FIG. 1. In this case, the recording head 12 may carry out recording when traveling in both directions, or it may carry out recording when traveling in one direction only.

Figure 2A:
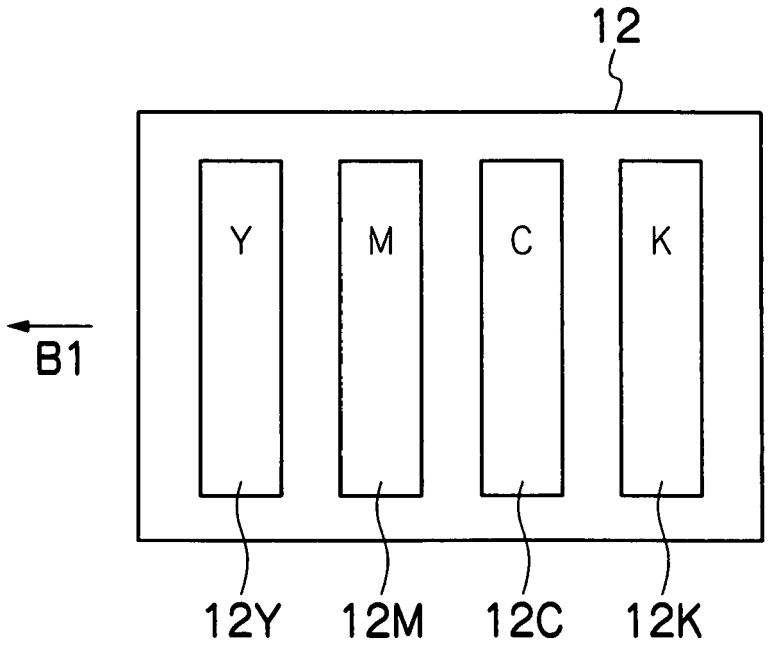
Figure 2B:
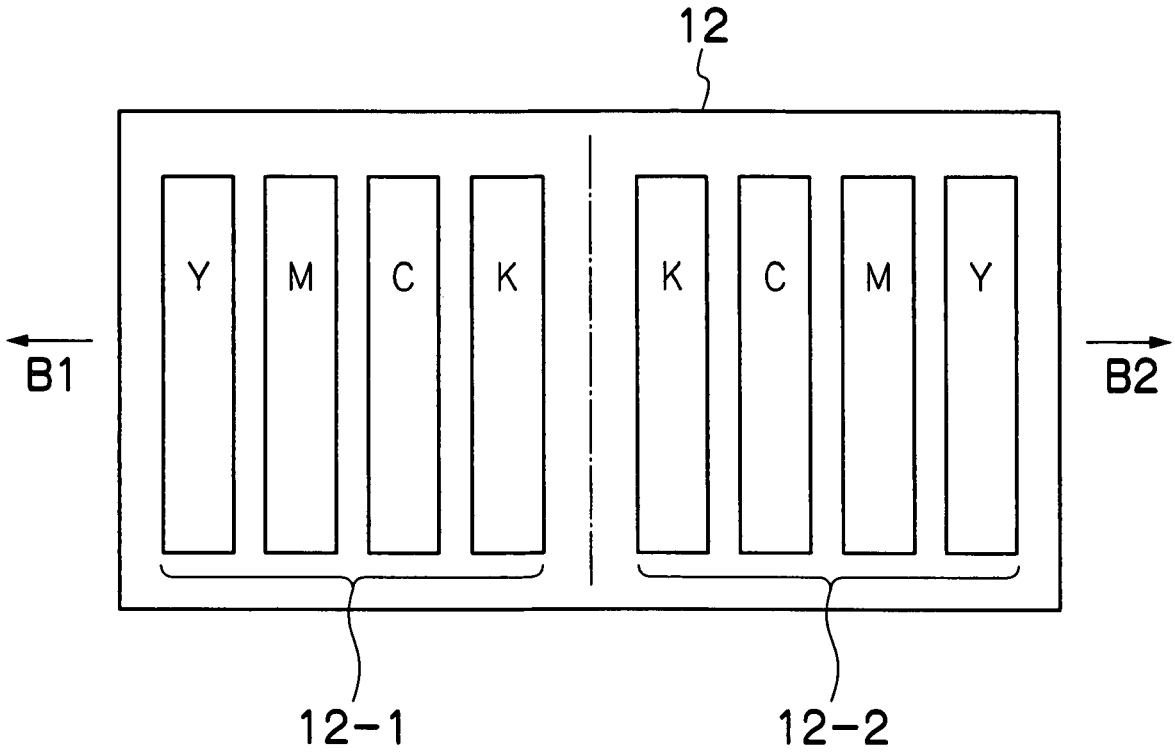

FIGS. 2A and 2B show plan diagrams of the recording head 12. In FIG. 2A, a yellow head 12Y which ejects yellow (Y) ink, a magenta head 12M which ejects magenta (M) ink, a cyan head 12C which ejects cyan (C) ink and a black head 12K which ejects black (K) ink, are disposed in such a manner that the nozzle rows of them lie substantially perpendicularly with respect to the direction of movement of the recording head 12 indicated by arrow B1.

Furthermore, on the other hand, if recording is carried out in both directions, then as shown in FIG. 2B, head groups 12-1 and 12-2 each comprising four heads 12Y, 12M, 12C and 12K may be disposed in laterally symmetrical positions on either side of the central line of the recording head 12. In this case, when the recording head 12 scans in the direction of the arrow B1, then recording may be carried out by using the head group 12-1, and when the recording head 12 scans in the direction of arrow B2, then the recording may be carried out by using the head group 12-2.

Furthermore, the recording head 12 according to the present embodiment has large nozzles which have a large ejection volume, and small nozzles which have a small ejection volume. Here, the ejection volume of the large nozzles is approximately 5 to 10 (pl), and the ejection volume of the small nozzles is approximately 1 to 2 (pl). Furthermore, in the present embodiment, the difference between the large nozzle ejection volume and the small nozzle ejection volume is formed by making the nozzle diameter of the large nozzles large and making the nozzle diameter of the small nozzles small.

Figure 3A:
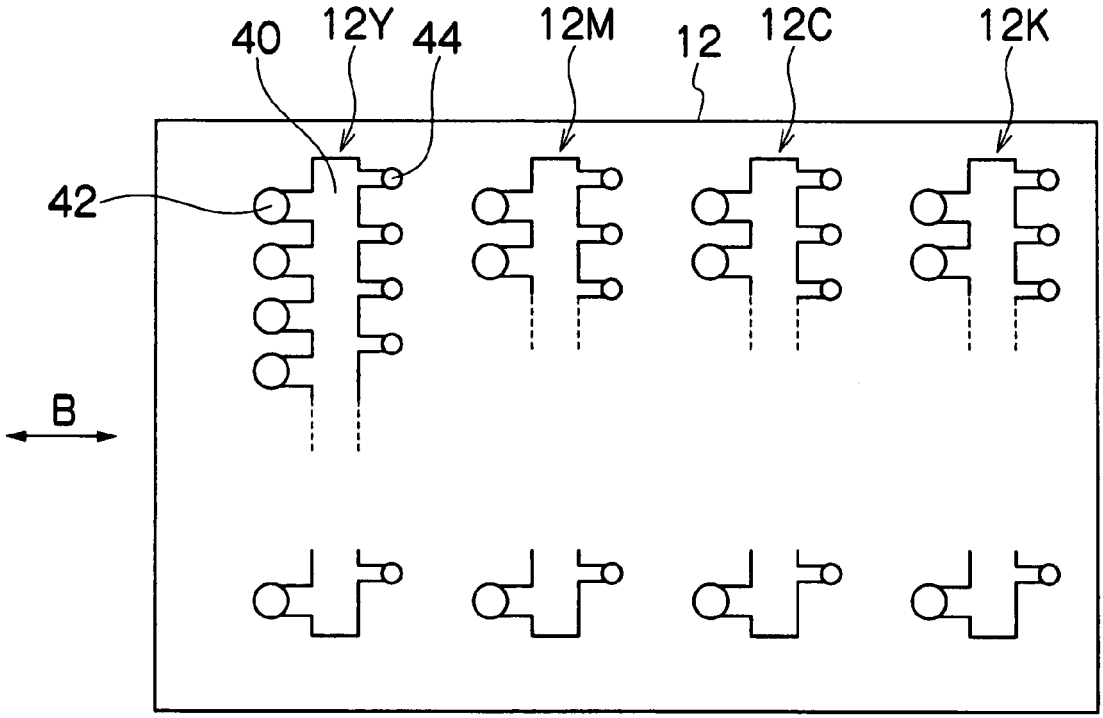
Figure 3B:
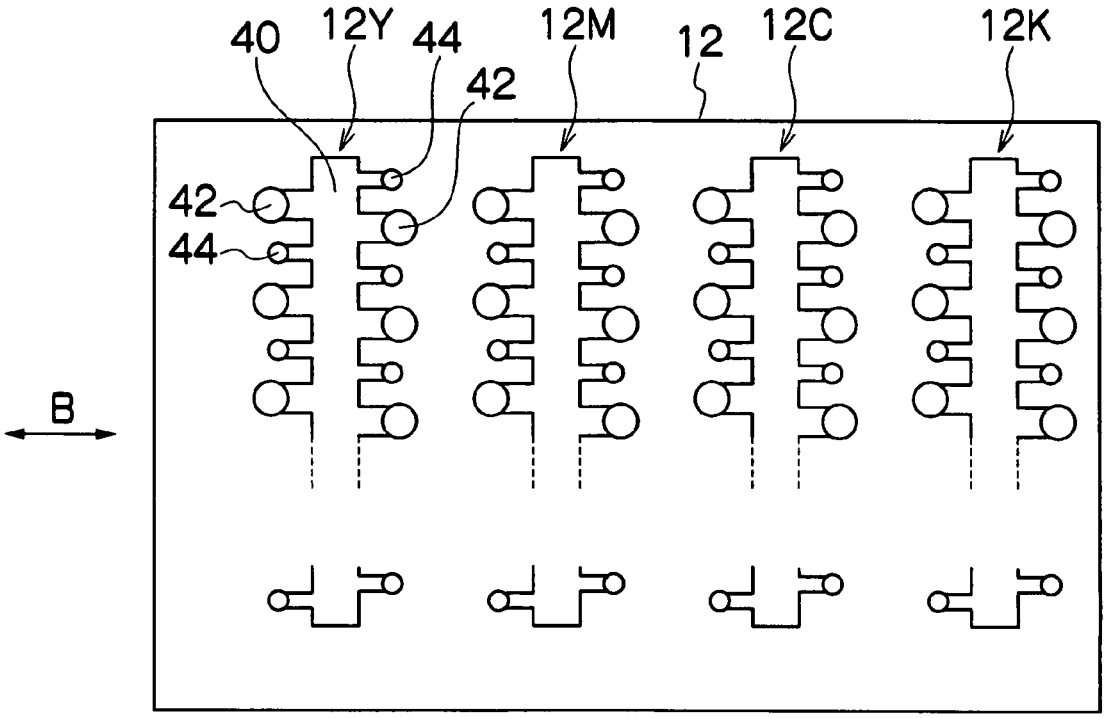

FIGS. 3A and 3B show examples of a nozzle arrangement which corresponds to the recording head 12 shown in FIG. 2A. In FIG. 3A, large nozzles 42 which have a large nozzle diameter are disposed on one side of a common liquid chamber 40 which extends in a direction substantially perpendicular to the scanning direction of the recording head 12 (main scanning direction) indicated by arrow B, and furthermore, small nozzles 44 which have a small nozzle diameter are disposed on the other side of the common liquid chamber 40.

Moreover, in the example shown in FIG. 3B, large nozzles 42 having a large nozzle diameter and small nozzles 44 having a small nozzle diameter are respectively disposed in an alternating fashion on either side of the common liquid chamber 40.

In this way, in any of the examples shown in FIGS. 3A and 3B, the internal flow channels leading to the nozzles inside the head are common channels, in such a manner that, for each color, ink is supplied from the same common liquid chamber 40 to the large nozzles 42 and the small nozzles 44 of the same color.

Furthermore, in the present embodiment, recording is carried out by using a pigment-based ink, and more particularly, an ink in which pigment particles having a size of 150 (nm) or greater account for not more than 5 (vol %) (i.e., volume percent) of the total volume of the pigment-based ink. When a pigment-based ink is used, there are problems relating to ejection stability and prevention of ejection failures, and therefore, in the particle size (particle diameter) distribution of the pigment-based ink, restrictions are applied to the particle size distribution of large-size particles, which have a large effect on ejection stability and the prevention of ejection failures.

Figure 4A:
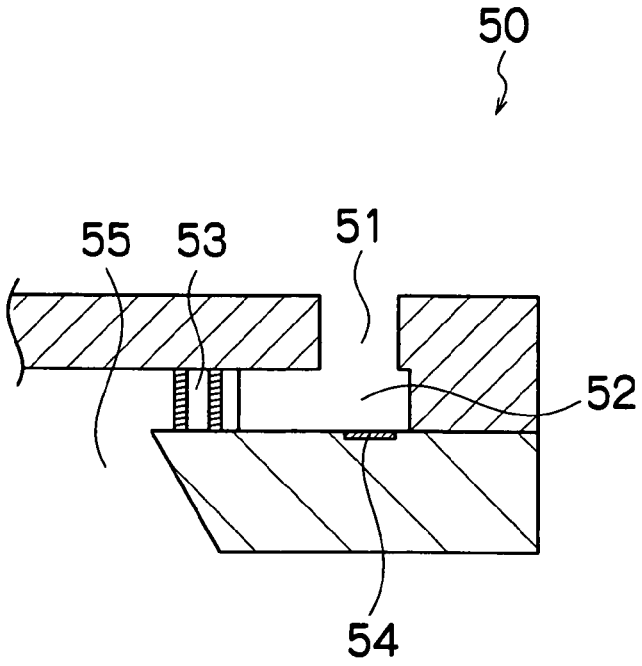
FIG. 4A is a cross-sectional diagram of a head and FIG. 4B is a cross-sectional diagram of a large nozzle, a small nozzle, and a common liquid chamber.
Figure 4B:
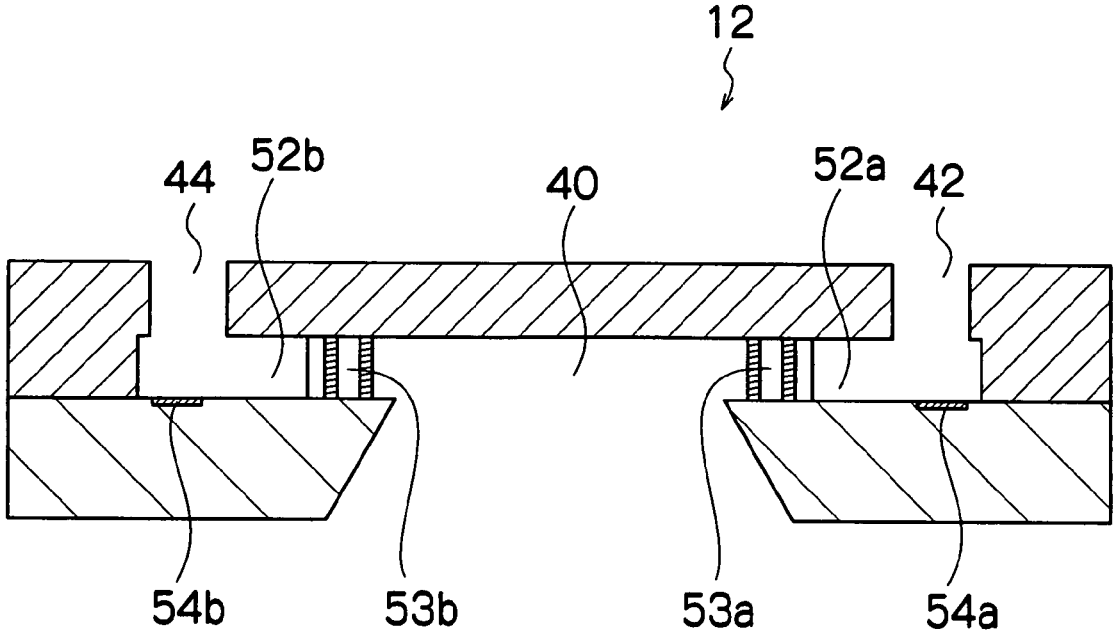

FIGS. 4A and 4B show cross-sectional diagrams of a head (12Y, 12C, 12M and 12K). The heads 12Y, 12C, 12M and 12K all have the same structure, and therefore these heads are represented here as a head 50, using a common reference numeral. Moreover, no distinction is made between the large nozzles 42 and the small nozzles 44 described above, and these are indicated simply as nozzles 51.

As shown in FIG. 4A, the head 50 is formed by means of pressure chambers 52 which are connected to nozzles 51 which eject ink, an electrical-thermal transducer element 54 is provided at each of the pressure chambers 52, and by applying an electrical pulse forming a recording signal to this element, thermal energy is applied to the ink, and the pressure of the air bubble created on the basis of the consequent film boiling in the ink is used to eject the ink droplet.

Furthermore, FIG. 4B shows a cross-sectional diagram of a large nozzle, a small nozzle and a common liquid chamber (common flow channel). The head 50 is formed by large nozzles 42 and small nozzles 44 which eject ink, and electrical-thermal transducing elements 54*a* and 54*b* provided below the respective pressure chambers 52*a* and 52*b*; the opening surface area of each large nozzle 42 is approximately 200 $\mu m^2$ and the opening surface area of each small nozzle is approximately 120 $\mu m^2$. Moreover, the common liquid chamber (common flow channel) 55 which supplies ink via the supply ports 53*a* and 53*b*, is connected to the pressure chambers 52*a* and 52*b*. After ink has been ejected from the nozzles 42 and 44, new ink is refilled into the pressure chambers 52*a* and 52*b* from the common liquid chamber 55, via the supply ports 53*a* and 53*b*, in preparation for the next ejection.

Moreover, in the present embodiment, a so-called thermal method is adopted which ejects liquid droplets by using thermal energy, but it is also possible to adopt another type of method, such as a piezo method which ejects liquid droplets by means of the deformation pressure of the piezoelectric elements.

Figure 5:
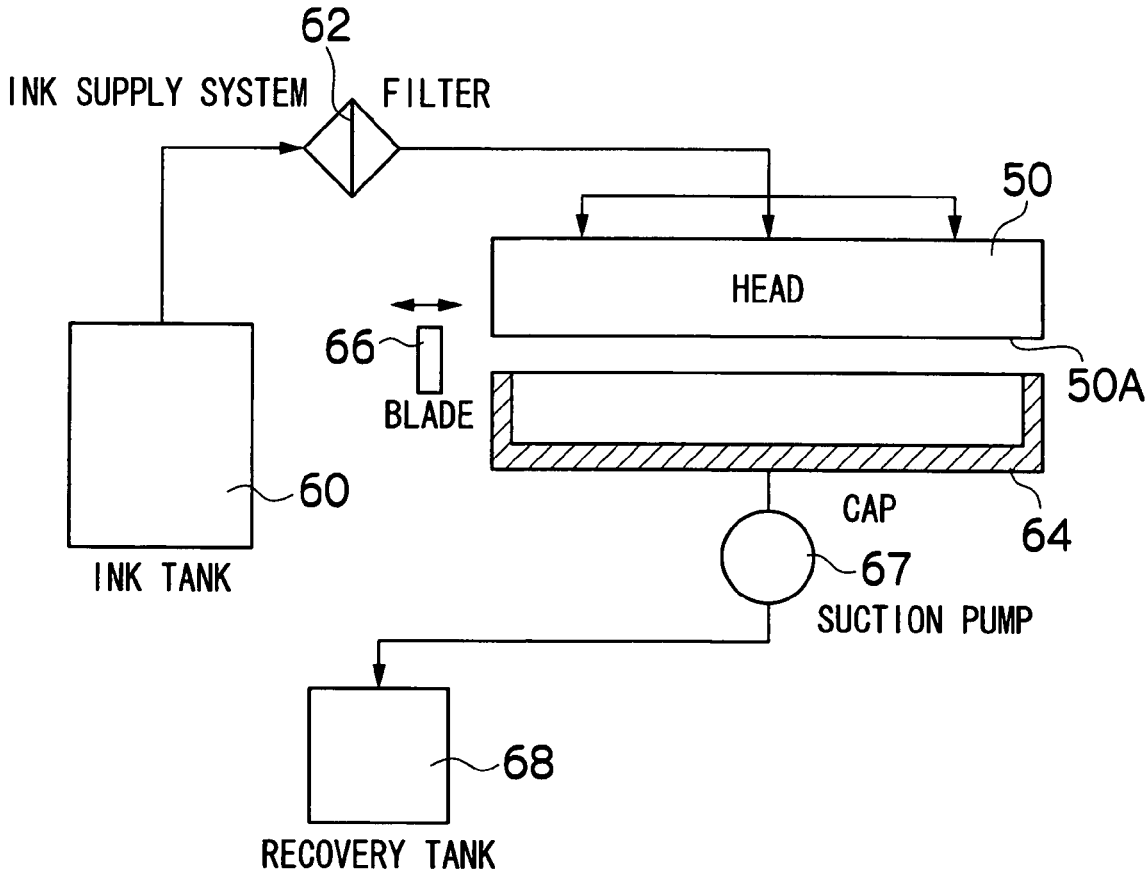
FIG. 5 is an approximate compositional diagram showing an ink supply system in the inkjet recording apparatus according to an embodiment of the present invention.

FIG. 5 shows the approximate composition of the ink supply system in the inkjet recording apparatus 1 according to the present embodiment.

In FIG. 5, the ink tank 60 is a base tank for supplying ink to the head 50. The ink tank 60 may adopt a system for replenishing ink by means of a replenishing port (not illustrated), or a cartridge system in which cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type. Moreover, a filter 62 for eliminating foreign material and air bubbles is provided at an intermediate position of the tubing which connects the ink tank 60 with the print head 50.

Although not shown in FIG. 5, desirably, a composition is adopted in which a subsidiary tank is provided in the vicinity of the head 50, or in an integrated manner with the head 50. The sub-tank has the function of improving damping effects and refilling, in order to prevent variations in the internal pressure inside the head 50.

Furthermore, the inkjet recording apparatus 1 is also provided with a cap 64 as a device to prevent the nozzles 51 from drying out or to prevent an increase in the ink viscosity in the vicinity of the nozzles, and a cleaning blade 66 as a device to clean the nozzle surface 50A.

A maintenance unit including the cap 64 and the cleaning blade 66 can be moved in a relative fashion with respect to the head 50 by a movement mechanism (not shown), and is moved from a predetermined holding position to a maintenance position below the head 50 as required. Here, the purge receptacles 34 and 36 shown in FIG. 1 are represented by the cap 64.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle surface 50A) of the head 50 by means of a blade movement mechanism (not shown). If there are ink droplets or foreign matter adhering to the nozzle surface 50A, then the nozzle surface 50A is wiped by causing the cleaning blade 66 to slide over the nozzle surface 50A, thereby cleaning same.

During printing (recording) or during standby, if the use frequency of a particular nozzle 51 has declined and the ink viscosity in the vicinity of the nozzle 51 has increased, then a preliminary ejection (purging operation) is performed toward the cap (purge receptacle) 64, in order to remove the ink that has degraded as a result of increasing in viscosity.

Moreover, when bubbles have become intermixed into the ink inside the head 50 (the ink inside the pressure chambers 52), the cap 64 is placed on the head 50, ink (ink in which bubbles have become intermixed) inside the pressure chambers 52 is removed by suction with a suction pump 67, and the ink removed by suction is sent to a recovery tank 68.

This suction operation is also carried out in order to suction and remove degraded ink which has hardened due to increasing in viscosity when ink is loaded into the head 50 for the first time, or when the print head starts to be used after having been out of use for a long period of time.

In other words, when a state in which ink is not ejected from the head 50 continues for a certain amount of time or longer, the ink solvent in the vicinity of the nozzles 51 evaporates and the ink viscosity increases. In such a state, ink can no longer be ejected from the nozzles 51 even if the electrical-thermal transducing elements 54 for ejection are operated. Therefore, before reaching such a state (while the ink is in a viscosity range that allows ejection of ink by means of the pressure of the air bubble generated by the electrical-thermal transducing elements 54), the electrical-thermal transducing elements 54 are operated in such a manner that a preliminary ejection is performed which causes the ink in the vicinity of the nozzle whose viscosity has increased to be ejected toward the cap (purge receptacle) 64. Furthermore, after cleaning away soiling on the surface of the nozzle surface 50A by means of a wiper, such as a cleaning blade 66, provided as a cleaning device on the nozzle surface 50A, a preliminary ejection is also carried out in order to prevent infiltration of foreign matter into the nozzles 51 because of the rubbing action of the wiper. The preliminary ejection is also referred to as "dummy ejection", "purge", "liquid ejection", and so on.

When bubbles have become intermixed into a nozzle 51 or a pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed in the ink inside the nozzle 51 and the pressure chamber 52, or when the viscosity of the ink inside the nozzle 51 increases to a certain level or more, ink can no longer be ejected from the nozzle even if the electrical-thermal transducing element 54 is operated. In a case of this kind, a cap 64 is placed on the nozzle surface 50A of the head 50, and the ink containing air bubbles or the ink of increased viscosity inside the pressure chambers 52 is suctioned by a pump 67.

However, this suction action is performed with respect to all of the ink in the pressure chambers 52, and therefore the amount of ink consumption is considerable. Therefore, it is desirable that a preliminary ejection is carried out, whenever possible, while the increase in viscosity is still minor. The cap 64 illustrated in FIG. 5 functions as a suctioning device and it may also function as a purging receptacle for receiving the ink that is ejected by preliminary ejection.

Moreover, a composition is adopted in which the inside of the cap 64 is divided by means of partitions into a plurality of areas corresponding to the nozzle rows, thereby achieving a composition in which suction can be performed selectively in each of the demarcated areas, by means of a selector, or the like. For example, this may be devised in such a manner that the large nozzles 42 and the small nozzles 44 described above can be suctioned respectively and separately.

Figure 6:
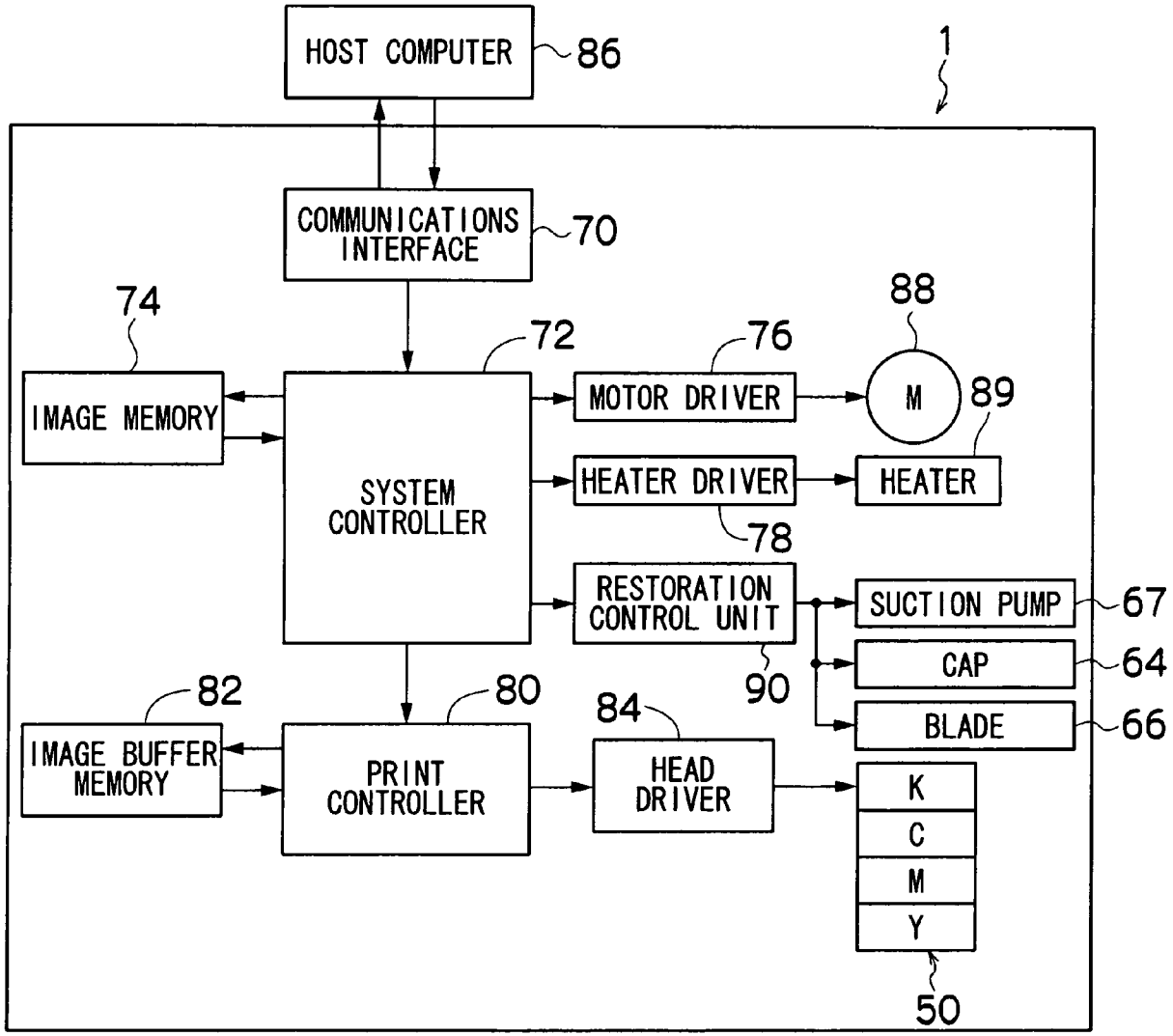
FIG. 6 is a partial block diagram showing the system composition of an inkjet recording apparatus according to an embodiment of the present invention.

FIG. 6 is a principal block diagram showing the system composition of an inkjet recording apparatus 1 according to the present embodiment.

The inkjet recording apparatus 1 comprises a communications interface 70, a system controller 72, an image memory 74, a motor driver 76, a heater driver 78, a print controller 80, an image buffer memory 82, a head driver 84, a restoration control unit 90, and the like.

The communications interface 70 is an interface unit for receiving image data transmitted by a host computer 86. For the communications interface 70, a serial interface, such as USB, IEEE 1394, an Ethernet (registered trademark), or a wireless network, or the like, or a parallel interface, such as a Centronics interface, or the like, can be used. It is also possible to install a buffer memory (not illustrated) for achieving high-speed communications. Image data sent from a host computer 86 is read into the inkjet recording apparatus 1 via the communications interface 70, and it is stored temporarily in the image memory 74. The image memory 74 is a storage device for temporarily storing an image input via the communications interface 70, and data is written to and read from the image memory 94 via the system controller 72. The image memory 74 is not limited to a memory consisting of a semiconductor element, and a magnetic medium, such as a hard disk, or the like, may also be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The heater driver 78 drives a heater 89 for drying the recording paper 10 after recording or for adjusting the temperature of the head 50, in accordance with commands from the system controller 72.

The print controller 80 is a control unit having a signal processing function for performing various treatment processes, corrections, and the like, in accordance with the control implemented by the system controller 72, in order to generate a signal for controlling printing (recording) from the image data in the image memory 74. The print controller 80 supplies the print control signal (image data) thus generated to the head driver 84. Prescribed signal processing is carried out in the print controller 80, and the ejection amount and the ejection timing of the liquid ink droplets from the head 50 are controlled via the head driver 84, on the basis of the image data. By this means, desired dot sizes and dot positions can be achieved.

The image buffer memory 82 is provided with the print controller 80, and image data, parameters, and other data are temporarily stored in the image buffer memory 82 when image data is processed in the print controller 80. FIG. 6 shows a mode in which the image buffer memory 82 is attached to the print controller 80; however, the image memory 74 may also serve as the image buffer memory 82. Moreover, a mode is also possible in which the print controller 80 and the system controller 72 are integrated and constituted by a single processor.

The head driver 84 drives the air bubble pressure generating devices of the heads 50 of the respective colors, on the basis of the print data supplied from the print controller 80. A feedback control system for maintaining constant drive conditions for the heads 50 may be included in the head driver 84.

Furthermore, the restoration control unit 90 serves to control the suction pump 67, the cap 64 and the cleaning blade 66, in order to perform a restoration operation for the head 50 during maintenance.

Next, the actions of the present embodiment are described below. The present embodiment seeks to address the issues of ink ejection stability and prevention of ejection failures, in addition to reducing the occurrence of floating mist and shortening the preliminary ejection time when a pigment-based ink is used. For this purpose, ejection is controlled in such a manner that, in preliminary ejection (purging) carried out during scanning (moving) for recording, without performing a suctioning operation, the preliminary ejection volume from the large nozzles 42 is greater than that of the small nozzles 44, and the preliminary ejection from the large nozzles is carried out before preliminary ejection from the small nozzles, and the like. Moreover, looking in particular at the size of the particles of pigment-based ink, it is sought to achieve further improvements in the ejection stability and the prevention of ejection failures, and the like, (especially in the small nozzles), by restricting the particle size (diameter) in the pigment-based ink.

Below, the actions according to the present embodiment are described with reference to the flowchart in FIG. 7.

Figure 7:
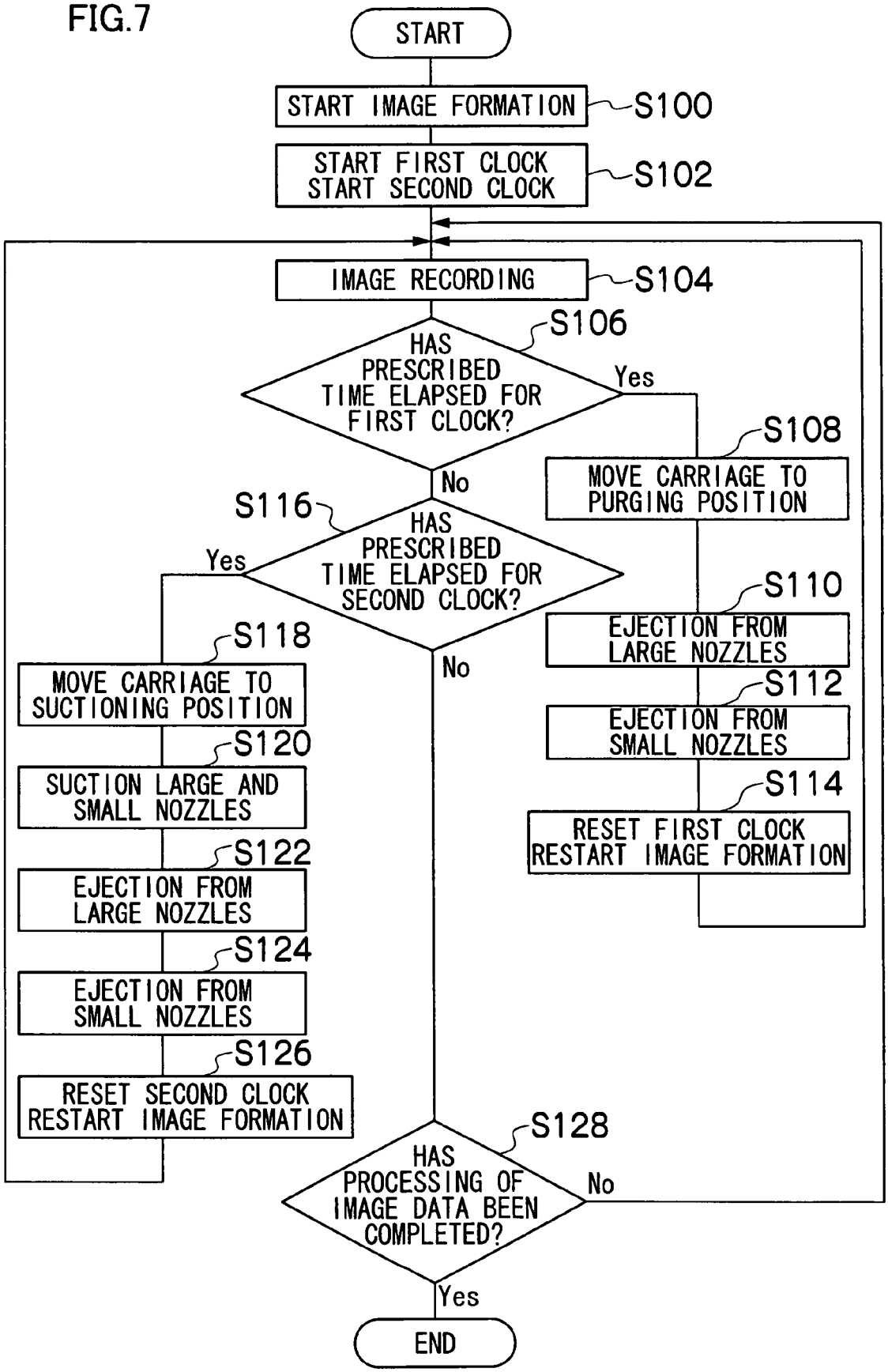
FIG. 7 is a flowchart showing preliminary ejection control under which actions of the inkjet recording apparatus according to an embodiment of the present invention are carried out.

FIG. 7 shows one example of the preliminary ejection control of the large nozzles and the small nozzles in the present embodiment. The example in FIG. 7 is an example of control in which the large nozzles perform ejection before small nozzles in the preliminary ejection.

Firstly, image formation is started at step S100 in FIG. 7. After starting image formation, at step S102, a first clock and a second clock are started. Here, the first clock serves to control the timing of the preliminary ejection (purging), and the second clock serves to control the timing of the preliminary ejection after suctioning.

Thereupon, an image is output at the step S104. In this, an image is formed by ejecting pigment-based inks respectively onto the recording paper 10, from the heads 12Y, 12C, 12M and 12K of the respective colors, while the recording heads 12 is moved reciprocally back and forth in the main scanning direction, which is a substantially perpendicular direction with respect to the conveyance direction of the recording paper 10 (sub-scanning direction), by driving the carriage 22 by means of the main scanning motor 32. In this case, as stated previously, it is possible to record images by the scanning (the movement) in one direction only, or it is possible to record images by scanning in both directions.

While image recording is carried out in this way, in the subsequent step S106, it is judged whether or not the first clock which controls the preliminary ejection timing during recording has passed a prescribed period of time. If the first clock has passed the prescribed time period, then even during recording of an image onto a sheet of recording paper 10, the image recording is interrupted, and at the next step S108, the carriage 22 is moved to a purging position. For example, the carriage 22 is moved to the position of the purge receptacle 34 provided on the left-hand side of the direction of conveyance of the recording paper 10 in FIG. 1. However, in this case, if the carriage 22 is positioned to the right-hand side of the center in the breadthways direction of the recording paper 10 in FIG. 1, then it is also possible to move the carriage 22 toward the purge receptacle 36 on the right-hand side.

Thereupon, purging is carried out, by firstly performing ejection from the large nozzles 42 toward the purge receptacle 34 (or purge receptacle 36) at step S110, and then performing ejection from the small nozzles 44 in the next step S112.

After the preliminary ejection has been completed from the large nozzles 42 and the small nozzles 44, at the next step, S114, the first clock is reset, the carriage 22 is returned to the position at which image recording was interrupted, and the procedure returns to step S104, where image formation is restarted.

Moreover, at step S106, if it is judged that the first clock has not yet reached the prescribed time period (after reset), then the procedure advances to the next step, S116, where it is judged whether or not the second clock, which controls the preliminary ejection timing after suctioning, has passed a prescribed time period.

At step S116, if the second clock has passed the prescribed time period, then the procedure advances to step S118, the image recording is interrupted, and the carriage 22 is moved to a suctioning position where the purge receptacle 36 shown in FIG. 1 is disposed. Thereupon, at the next step, S120, a purge receptacle (cap) 36 is placed in close contact with the recording head 12 (head 50), the suction pump 67 is driven, and the ink inside the large nozzles 42 and the small nozzles 44 is suctioned.

Thereupon, at step S122, the large nozzles 42 perform ejection toward the purge receptacle 36, whereupon at step S124, the small nozzles 44 perform ejection toward the purge receptacle 36, in a similar manner.

The second clock is reset at step S126, the carriage 22 is returned to the position where the image recording was interrupted, and the procedure then reverts to the step S104 and image recording is restarted.

In this way, image recording is continued while repeating "purging performed during image recording" and "a combination of suctioning and purging". When the image data ends at step S128, image recording terminates.

Furthermore, it is desirable that preliminary ejection control should be carried out in such a manner that the ejection volume from the large nozzles 42 is greater than the ejection volume from the small nozzles 44, not only in the case of preliminary ejection after suctioning, but also in the case where preliminary ejection is performed from the large nozzles 42 and the small nozzles 44 during image recording. By raising the ejection volume from the large nozzles 42, great beneficial effects are obtained not only in respect of preventing floating mist, and shortening of the preliminary ejection time, but also in respect of stabilizing ejection and suppressing ejection failures. Since the large nozzles 42 and the small nozzles 44 receive a supply of ink from the same common liquid chamber 40 (55), then by increasing the preliminary ejection volume (e.g., increasing the number of preliminary ejection operations, or increasing the preliminary ejection frequency) from the large nozzles 42, it is possible to eject (expel) the old ink inside the common liquid chamber 40 (55), effectively, and therefore it is possible to improve the ejection characteristics of the small nozzles 44, which are especially susceptible to the effects of degradation of the liquid. Furthermore, since the number of preliminary ejection operations performed from the small nozzles 44 can be reduced, then it is possible to shorten the overall maintenance time required for preliminary ejection.

Figure 8:
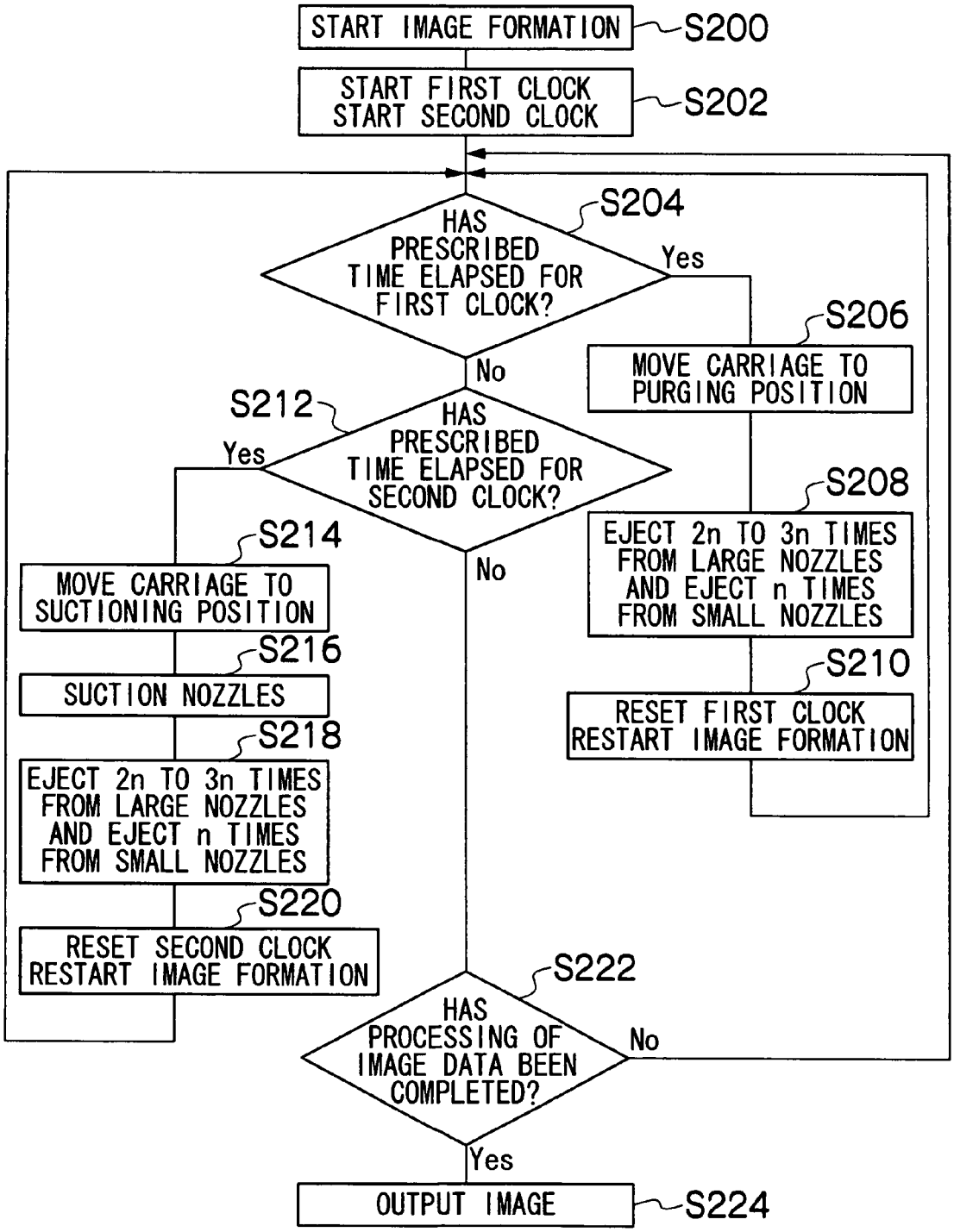
FIG. 8 is a flowchart showing a further example of preliminary ejection control under which actions of the inkjet recording apparatus according to an embodiment of the present invention are carried out.

Moreover, another example of the control is shown in the flowchart in FIG. 8. As shown in FIG. 8, ejection may be controlled in such a manner that the number of ejections from the large nozzles 42 during preliminary ejection (namely, the number of ejections performed from one large nozzle 42), is greater than the number of ejections from the small nozzles 44 (namely, the number of ejections performed from one small nozzle 44). In other words, at step S218 in FIG. 8, it is possible that the large nozzles 42 each perform 2n ejections and the small nozzles 44 each perform n ejections. Moreover, at step S208, it is possible that the large nozzles 42 each perform 2n to 3n ejections and the small nozzles 44 each perform n ejections. For example, if one large nozzle 42 is made to perform ejection 100 times, then one small nozzle is made to perform ejection 50 times. By this means, it is possible to make the ejection volume from each of the large nozzles 42 greater than the ejection volume from each of the small nozzles 44.

Furthermore, it is also possible to make the ejection frequency from the large nozzles 42 during preliminary ejection higher than the ejection frequency of the small nozzles 44. For example, the control in FIG. 8 may be implemented by making the ejection frequency of the large nozzles 42 twice as high as the ejection frequency of the small nozzles 44.

By making the number of ejections from the large nozzles 42 greater than the number of ejections from the small nozzles 44, it is possible to eject the old ink inside the common liquid chamber 40 (55), effectively, in large volume, from the large nozzles 42, and therefore ejection stability can be improved.

Furthermore, the present inventor confirmed by experimentation that it is possible to achieve further improvement in stabilizing ejection and preventing ejection failures (especially in the small nozzles 44), by controlling the size of the particles in the pigment-based ink in such a manner that the particles having a size (diameter) equal to or greater than 150 nm account for 5 volume % or less of the particles.

FIG. 9 shows the results of this.

In this experimentation, a recording head capable of ejecting droplets of pigment-based ink and having large nozzles and small nozzles was used, and lines were printed onto a prescribed recording medium (inkjet photograph paper) while moving the recording head in the main scanning direction. Ejection failures (non-ejection) of the nozzles and deviation of the lines were confirmed on the basis of the recorded image.

The ink used in this experimentation was an ink prepared by combining 5 wt % (weight percent) of pigment, 10 wt % of diethylene glycol, 10 wt % of glycerine and 1 wt % of a surfactant, with water as the remainder. Furthermore, the occurrence of ejection failures in the nozzles and the directional stability of the liquid ejection vary with difference in the particle size distribution (particle diameter distribution) of the pigment-based ink, and in particular, difference in the content of particles of large particle size in the particle size distribution, and therefore inks having different pigment particle size distributions were prepared. Since the extent of the distribution of pigment particles having a large size is a particular problem in the pigment particle size distribution, an index value "$D_{95}$" was assigned to each of the inks used, to indicate the particle size value at which a cumulative volume of 95 vol % was reached when accumulating the particle size distribution starting from the side of the small particle size, according to measurement by a particle size distribution measurement apparatus UPA-EX150 (manufactured by Nikkiso Co., Ltd.).

During measurement, the particle size distribution measurement apparatus UPA-EX150 (manufactured by Nikkiso Co. Ltd.) was set to the following conditions: on the basis of volume distribution display, the particle index of refraction was 1.51, the particle permeability was permeable, the particle shape was aspherical, the solvent was water, the solvent index of refraction was 1.333, the filter was standard, the sensitivity was standard, and the measurement was carried out at a temperature of 25° C. using a solution diluted 100 times in water. Furthermore, the value of "$D_{95}$" uses the particle size value (nm) indicated by the 95% cumulative result of the series of measurement values displayed as the measurement result.

In the column of "$D_{95}$ of PIGMENT INK (μm)" in FIG. 9, for example, "130" means pigment ink having cumulative value $D_{95}$ in pigment particle size distribution of 120 to 130 nm; "150" means pigment ink having cumulative value $D_{95}$ in pigment particle size distribution of 140 to 150 nm; and "160" means pigment ink having cumulative value $D_{95}$ in pigment particle size distribution of 150 to 160 nm.

In the experiments, lines were printed by performing 5000 ejections during the scanning (head movement), whereupon the head was left for ten seconds, and then purging was carried out. After that, lines were printed again by performing 5000 ejections during the scanning, for a second time. The occurrence of ejection failures and line deviation for the small nozzles in the case of the second line printing operation were evaluated. In the purging, experimentation was carried out by using different purging control methods, thereby allowing confirmation of the relationship between the purging control method, and the occurrence of ejection failures and line deviation in the small nozzles.

The purge control is performed under conditions where the total number of ejections from the large and small nozzles was 200. Under this purge control, the "CONTROL EXAMPLE 1" in FIG. 9 means that the ejection from the large nozzles was performed 100 times and then the ejection from the small nozzles was performed 100 times; the "CONTROL EXAMPLE 2" in FIG. 9 means that the number of ejections performed from the large nozzles was three times greater than the number of ejections performed from the small nozzles (i.e., 150 ejections from the large nozzles and 50 ejections from the small nozzles); and the "CONTROL EXAMPLE 3" in FIG. 9 means that both the large nozzles and the small nozzles performed ejections 100 times each, simultaneously.

More specifically, in the "CONTROL EXAMPLE 1", ejection of 5000 dots (line printing) was performed, then non-ejection was performed for 10 seconds, then 100 purging ejections were performed from the large nozzles, then 100 purging ejections were performed from the small nozzles, and then line printing was performed. In the "CONTROL EXAMPLE 2", ejection of 5000 dots (line printing) was performed, then non-ejection was performed for 10 seconds, then 150 purging ejections were performed from the large nozzles and 50 purging ejections were performed from the small nozzles, and then line printing was performed. In the "CONTROL EXAMPLE 3", ejection of 5000 dots (line printing) was performed, then non-ejection was performed for 10 seconds, then 100 purging ejections were performed from each of the large nozzles and the small nozzles simultaneously, and then line printing was performed.

Moreover, in the experiment, lines were printed by ejecting ink from 100 large nozzles and 100 small nozzles in the head, and of these, the printing lines created by the small nozzles were observed. The occurrence of ejection failures was judged by counting the number of nozzles that have performed ejection, out of the 100 small nozzles, and assigning the following verdicts in FIG. 9: "good" for a 99% or more to 100% ejection rate (i.e., ejection rate of 99% or more to 100%), "average" for a 95% or more to less than 98% ejection rate (i.e., ejection rate of 95% or more to less than 98%), and "poor" for less than a 95% ejection rate (i.e., ejection rate of less than 95%). Moreover, line deviation was assessed by taking any line showing a deviation in the depositing position of 10 μm or greater, to be line deviation, and then counting the number of nozzles which did not produce line deviation, of the line images printed by the 100 small nozzles, and assigning the following verdicts: "good" for a 90% to 100% deviation-free state (i.e., deviation-free state of 90% or more to 100%), "average" for a 60% or more and less than 90% deviation-free state (i.e., deviation-free state of 60% or more to below 90%), and "poor" for a less than 60% deviation-free state (i.e., deviation-free state of below 60%).

In FIG. 9, in Present Embodiments 1 to 4, the conditions were as follows: the size ($D_{95}$) corresponding to the cumulative 95 vol % of the particle size distribution starting from the small particle side was less than 150 nm (in other words, the ratio of particles having a particle size equal to or greater than 150 (nm) was not more than 5 (vol %)), and furthermore, purge control was implemented in such a manner that the large nozzles performed ejection first during purging, or ejection was performed a greater number of times from the large nozzles. In this case, ejection failures did not occur (or little occur) and there were few line deviations. In other words, the smaller the particles of the pigment-based ink, the smaller the effect on the ejection characteristics, and it was found that, provided that the pigment particles having a particle size smaller than 150 nm account for not less than 95 (vol %), then the effects of the pigment-based ink on the ejection characteristics can be ignored.

On the other hand, in FIG. 9, in the Comparative Examples 1 and 2, the conditions were as follows: the large nozzles and small nozzles ejected simultaneously during purging, and both performed the same number of ejections. In this case, the occurrence rate of ejection failure nozzles increased. Furthermore, in the Comparative Examples 3 and 4, the conditions were that $D_{95}$ was equal to or greater than 150 nm, and under these conditions, both the occurrence rate of ejection failure nozzles and the occurrence rate of line deviations increased.

As described above, the present embodiment uses an inkjet recording apparatus which performs image recording using pigment-based ink, in one direction or both directions while a recording head which comprises large nozzles having a large nozzle diameter and a large ejection volume and small nozzles having a small nozzle diameter and a small ejection volume provided in the same head, is moved bi-directionally in the breadthways direction of the recording paper, which is substantially perpendicular to the direction of conveyance of the recording paper. The large nozzles and the small nozzles for the same color share a common flow channel inside the head, and when preliminary ejection is carried out during image recording, or when preliminary ejection is carried out after suctioning, ejection is performed a greater number of times from the large nozzles than from the small nozzles, or ejection is performed from the large nozzles before performing ejection from the small nozzles. Alternatively, ejection is performed a greater number of times from the large nozzles than from the small nozzles, and the ejection from the large nozzles is performed before performing the ejection from the small nozzles.

Moreover, by ensuring that the rate of particles having a size equal to or greater than 150 nm in the pigment-based ink is equal to or less than 5 (vol %), and by making the ejection volume from each of the large nozzles approximately 5 to 10 (pl), and making the ejection volume from each of the small nozzles 1 to 2 (pl), it is possible to prevent floating mist and to shorten the preliminary ejection time, as well as improving the stabilization of ejection and suppression of ejection failures, and therefore high-quality image recording and guaranteed reliability can be achieved. In particular, it is possible to improve the ejection stability and prevention of ejection failures in the small nozzles.

Next, a further embodiment of an inkjet recording apparatus according to the present invention is described below.

Figure 10:
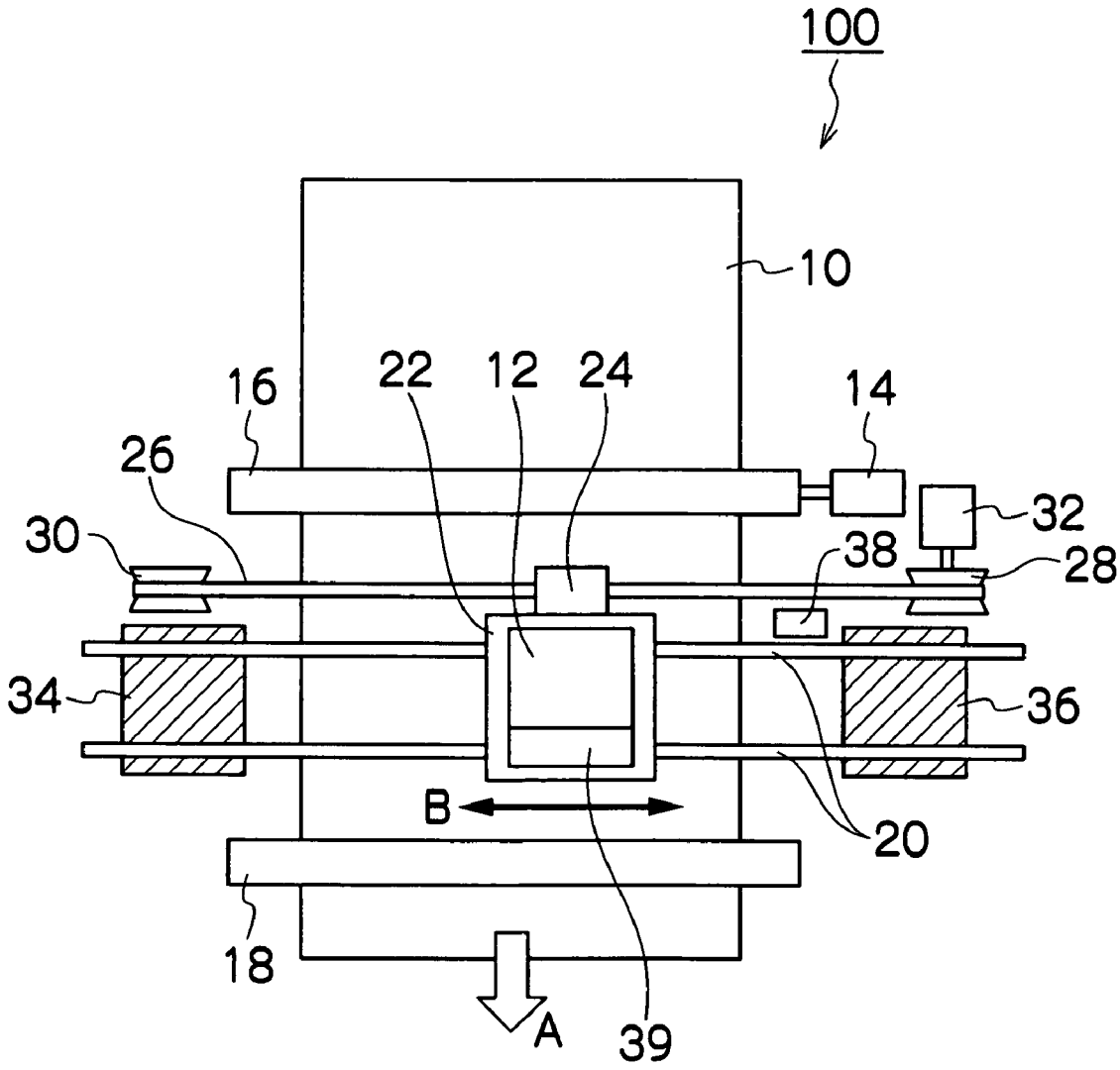
FIG. 10 is a general compositional diagram showing the principal part of a further inkjet recording apparatus of an embodiment relating to the present invention.

FIG. 10 is a plan diagram showing the general composition of the principal part of an inkjet recording apparatus of a further embodiment relating to the present invention.

The inkjet recording apparatus 100 according to the present embodiment is substantially similar to the inkjet recording apparatus 1 shown in FIG. 1 described previously. The inkjet recording apparatus 100 according to the present embodiment is different from the inkjet recording apparatus 1 described previously in that an ink type determination unit 39 for determining the type of ink ejected from the recording head 12 is appended to the recording head 12 on the carriage 22.

A possible configuration for the ink type determination unit 39 may be one where, for example, the ink cartridge is equipped with a memory, or the like, which stores particle size distribution information relating to the pigment in the pigment-based ink, or the ink cartridge is equipped with barcode information indicating the particle size distribution information, and this information is read in by a memory information reading unit or a barcode reading unit, or the like, which is attached to the carriage. The installation position of the ink type determination unit 39 is not limited to this.

The composition of the recording head 12 is similar to that of the foregoing embodiment which is shown in FIGS. 2A and 2B. Moreover, the nozzle arrangements and the head cross-sections are similar to those shown in FIGS. 3A and 3B, and FIGS. 4A and 4B.

Furthermore, the general composition of the ink supply system of the inkjet recording apparatus 100 according to the present embodiment is similar to that shown in FIG. 5 described previously. When the type of ink is changed, the type of ink is determined by the ink type determination unit 39. There are no particular limitations of this ink type determination method and it is possible, for example, to identify the ink type information by means of a bar code, or the like, and thus determine the ink type, as described above. Ejection is controlled in accordance with the ink type thus determined.

Figure 11:
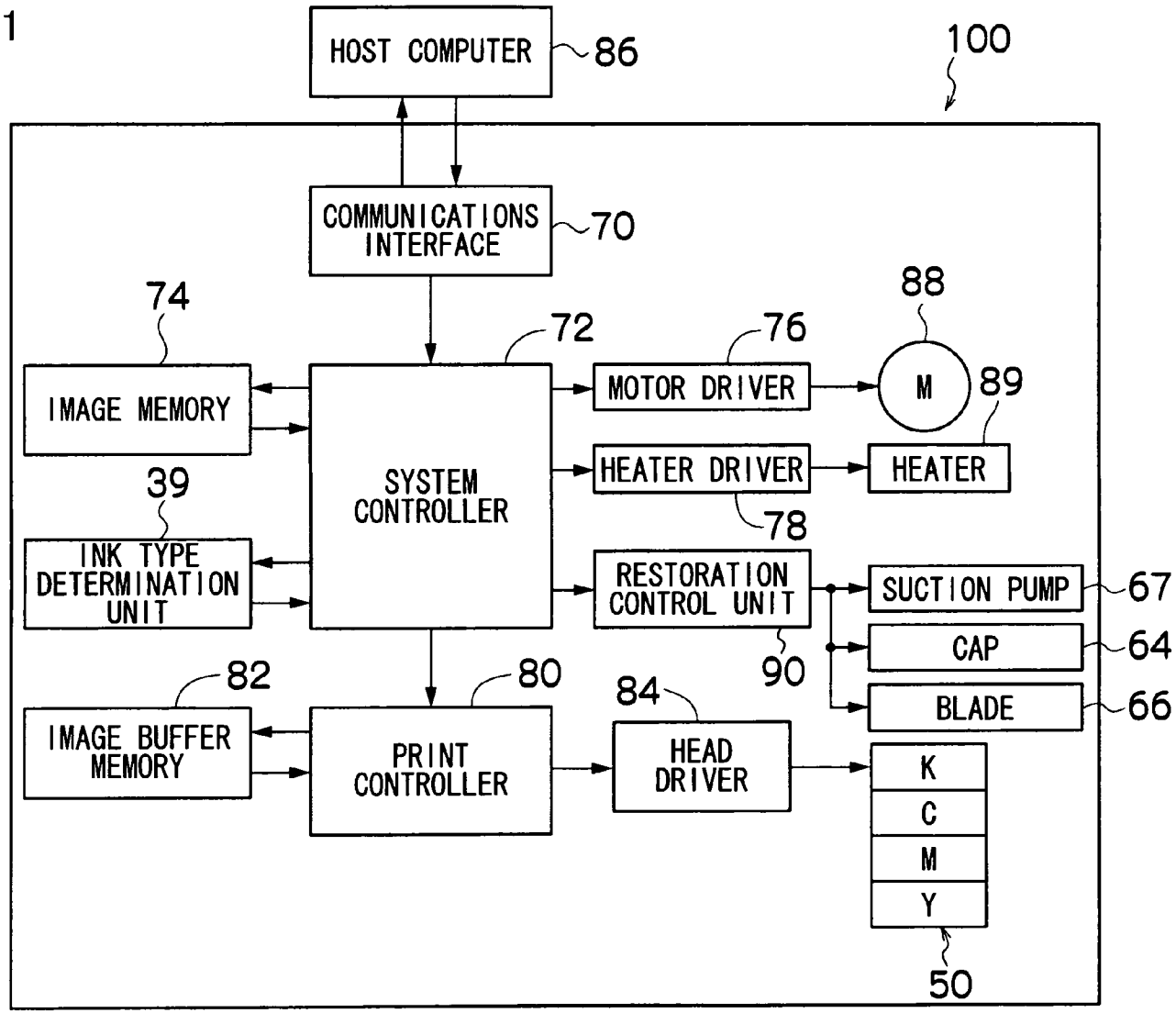
FIG. 11 is a partial block diagram showing the system composition of an inkjet recording apparatus according to an embodiment of the present invention.

FIG. 11 is a principal block diagram showing the system composition of an inkjet recording apparatus 100 according to the present embodiment.

As shown in FIG. 11, the system composition of the inkjet recording apparatus 100 according to the present embodiment is substantially the same as the system composition of the inkjet recording apparatus 1 shown in FIG. 6 which is described above. The point of difference is that, in the present embodiment, an ink type determination unit 39 is provided.

In other words, determination signals from the ink type determination unit 39 are input to the system controller 72, and purging and preliminary ejection, and the like, are controlled by the system controller 72 via the restoration control unit 90, in accordance with the determination signals.

Below, the actions of the present embodiment are described. In the present embodiment, in particular, the particle size distribution information is determined from the type of the pigment-based ink, and the control method for purging and preliminary ejection is changed in accordance with the particle size distribution information of the pigment-based ink thus determined. More specifically, stated in simple terms, if almost all of the pigment in the ink is pigment of fine particle size, then purging or preliminary ejection is carried out simultaneously from the large nozzles and the small nozzles. Moreover, if the ink contains pigments of large particle size, then the large nozzles perform ejection before the small nozzles, or a greater number of times than the small nozzles. In this way, it is sought to improve ejection stability and prevent ejection failures in the small nozzles, in particular, thus making it possible to achieve stable high-quality printing and ensure good reliability.

Furthermore, the present inventor also varied the purging control applied for inks of different pigment particle size distribution, and evaluated the ejection stability and the occurrence of ejection failures in the small nozzles; by this experimentation, he confirmed that it is possible to achieve stable ejection and prevent ejection failures in the small nozzles, by adopting a purging control method which is suited to the pigment particle size distribution. The results of this are shown in FIG. 12 and FIG. 13.

In this experimentation, a recording head capable of ejecting droplets of pigment-based ink and having large nozzles and small nozzles was used and lines were printed onto a prescribed recording medium (inkjet photograph paper) while the recording head is moved in the main scanning direction. Ejection failures in the nozzles and deviation of the lines were confirmed on the basis of the recorded image.

The ink used in this experimentation was an ink prepared by combining 5 wt % of pigment, 10 wt % of diethylene glycol, 10 wt % of glycerine and 1 wt % of a surfactant, with water as the remainder. Furthermore, the occurrence of ejection failures in the nozzles and the directional stability of the liquid ejection vary with difference in the particle size distribution of the pigment-based ink, and in particular, difference in the content of particles of large particle size in the particle size distribution, and therefore inks having different pigment particle size distributions were prepared. Since the extent of the distribution of pigment particles having a large size largely affects the pigment particle size distribution, an index value "$D_{95}$" was assigned to each of the inks used, to indicate the particle size value at which a cumulative volume of 95 vol % was reached when accumulating the particle size distribution starting from the side of the small particle size, based on measurement by a particle size distribution measurement apparatus UPA-EX150 (manufactured by Nikkiso Co. Ltd.) During measurement, the particle size distribution measurement apparatus UPA-EX150 (manufactured by Nikkiso Co. Ltd.) was set to the following conditions: on the volume distribution display, the particle index of refraction was 1.51, the particle permeability was permeable, the particle shape was aspherical, the solvent was water, the solvent index of refraction was 1.333, the filter was standard, the sensitivity was standard; and the measurement was carried out at a temperature of 25° C. using a solution diluted 100 times in water. Furthermore, as the value of "$D_{95}$", the particle size value (nm) indicated by the 95% cumulative result of the series of measurement values displayed as the measurement result was used.

In the column of "INK ($D_{95}$)" in FIG. 12, for example, "110" means pigment ink having cumulative value $D_{95}$ in pigment particle size distribution of 100 to 110 nm; "130" means pigment ink having cumulative value $D_{95}$ in pigment particle size distribution of 120 to 130 nm; "150" means pigment ink having cumulative value $D_{95}$ in pigment particle size distribution of 140 to 150 nm; and "160" means pigment ink having cumulative value $D_{95}$ in pigment particle size distribution of 150 to 160 nm.

In the experiments, lines were printed by performing 5000 ejections while the scanning (head movement) was performed, respectively from 100 large nozzles and 100 small nozzles in the head, whereupon the head was left for ten seconds. After that, purging was carried out, and lines were printed again by performing 5000 ejections while the scanning (head movement) was performed, for a second time. The occurrence of ejection failures and line deviation for the small nozzles in the case of the second line printing operation were evaluated.

The occurrence of ejection failures was judged by counting the number of nozzles that have performed ejection, out of 100 small nozzles, and assigning the following verdicts: "good" for a 99% to 100% ejection rate (i.e., not less than 99% to 100%), "average" for a 95% to 98% ejection rate (i.e., not less than 95% to less than 99%), and "poor" for less than a 95% ejection rate. Moreover, line deviation was assessed by taking any line showing a deviation in the depositing position of 10 μm or greater, to be line deviation, and then counting the number of nozzles which did not produce line deviation, on the basis of the line images printed by the 100 small nozzles, and assigning the following verdicts: "good" for a 90% to 100% deviation-free state (i.e., not less than 90% to 100%), "average" for a 60% or more to less than 90% deviation-free state, and "poor" for a less than 60% deviation-free state.

The purging control methods were carried out under the following control A or control B: control A, in which the ejections are performed from the large nozzles before performing the ejections from the small nozzles, and the ejections are performed 100 times each from both the large and small nozzles; or control B, in which the number of ejections performed by the large nozzles is three times greater than that of the small nozzles (i.e., in this case, large nozzles: 150 ejections; small nozzles: 50 ejections). In other words, under the control A, the ejection of 5000 dots (line printing) was performed; then, the head was left for 10 seconds; then, 100 purging ejections were performed from the large nozzles; then, 100 purging ejections were performed from the small nozzles; and then, line printing was performed. Moreover, under the control B, the ejection of 5000 dots (line printing) was performed; then, the head was left for 10 seconds; then 150 purging ejections were performed from the large nozzles and 50 purging ejections were performed from the small nozzles; and then line printing was performed. In FIG. 12, the conditions were that the size ($D_{95}$) corresponding to the cumulative 95 vol % of the particle size distribution starting from the small side was less than 150 nm (namely, that the ratio of particles having a particle size equal to or greater than 150 nm was not more than 5 vol %), and furthermore, that purge control was implemented in such a manner that the large nozzles performed ejection first during purging, or ejection was performed a greater number of times from the large nozzles. In this case, ejection failures did not occur and there were few line deviations.

In FIG. 13, "CONTROL C" indicates control where ejection is performed simultaneously 100 times each from the large and small nozzles, which is based on a different purging control method. More specifically, under the "CONTROL C", ejection of 5000 dots (line printing) was performed; then, the head was left for 10 seconds; then, 100 purging ejections were performed from both large nozzles and small nozzles (simultaneous ejection); and then, line printing was performed. In the case of the control C, there is no occurrence of ejection failures and line deviation is small, under conditions where the size ($D_{95}$) corresponding to the cumulative 95 vol % of the particle size distribution starting from the small side was less than 110 nm (the ratio of particles having a particle size equal to or greater than 110 nm is not more than 5 vol %).

In the column of "INK ($D_{95}$)" in FIG. 13, "100" means pigment ink having cumulative value $D_{95}$ in pigment particle size distribution of 90 to 100 nm; "110" means pigment ink having cumulative value $D_{95}$ in pigment particle size distribution of 100 to 110 nm; "130" means pigment ink having cumulative value $D_{95}$ in pigment particle size distribution of 120 to 130 nm; "150" means pigment ink having cumulative value $D_{95}$ in pigment particle size distribution of 140 to 150 nm; and "160" means pigment ink having cumulative value $D_{95}$ in pigment particle size distribution of 150 to 160 nm.

The occurrence of ejection failures was judged by counting the number of nozzles that have performed ejection, out of 100 small nozzles, and assigning the following verdicts: "good" for a 99% to 100% ejection rate (i.e., not less than 99% to 100%), "average" for a 95% to less than 99% ejection rate (i.e., not less than 95% to less than 99%), and "poor" for less than a 95% ejection rate. Moreover, line deviation was assessed by taking any line showing a deviation in the depositing position of 10 μm or greater, to be line deviation, and then counting the number of nozzles which did not produce line deviation, on the basis of the line images printed by the 100 small nozzles, and assigning the following verdicts: "good" for a 90% to 100% deviation-free state (i.e., not less than 90% to 100%), "average" for a 60% or greater to less than 90% deviation-free state, and "poor" for a less than 60% deviation-free state.

According to the experiments in FIG. 12 and FIG. 13, it was discovered that, when the pigment particle size was such that the size ($D_{95}$) corresponding to the cumulative 95 vol % of the particle size distribution starting from the small side was less than 150 nm (the ratio of particles having a particle size equal to or greater than 150 nm was not more than 5 vol %), then by adopting purging control whereby the large nozzles perform ejection first or ejection is performed a greater number of times from the large nozzles, ejection failures do not occur and there are few line deviations. Moreover, in the case of a very fine pigment in which the $D_{95}$ value of the particle size is less than 110 nm, even if purging is controlled in such a manner that the same number of ejections are performed simultaneously from the large and small nozzles, it was judged that this had no effect on the ejection stability or the prevention of ejection failures.

Below, the actions according to the present embodiment are described with reference to the flowcharts in FIG. 14 and FIG. 15.

Figure 14:
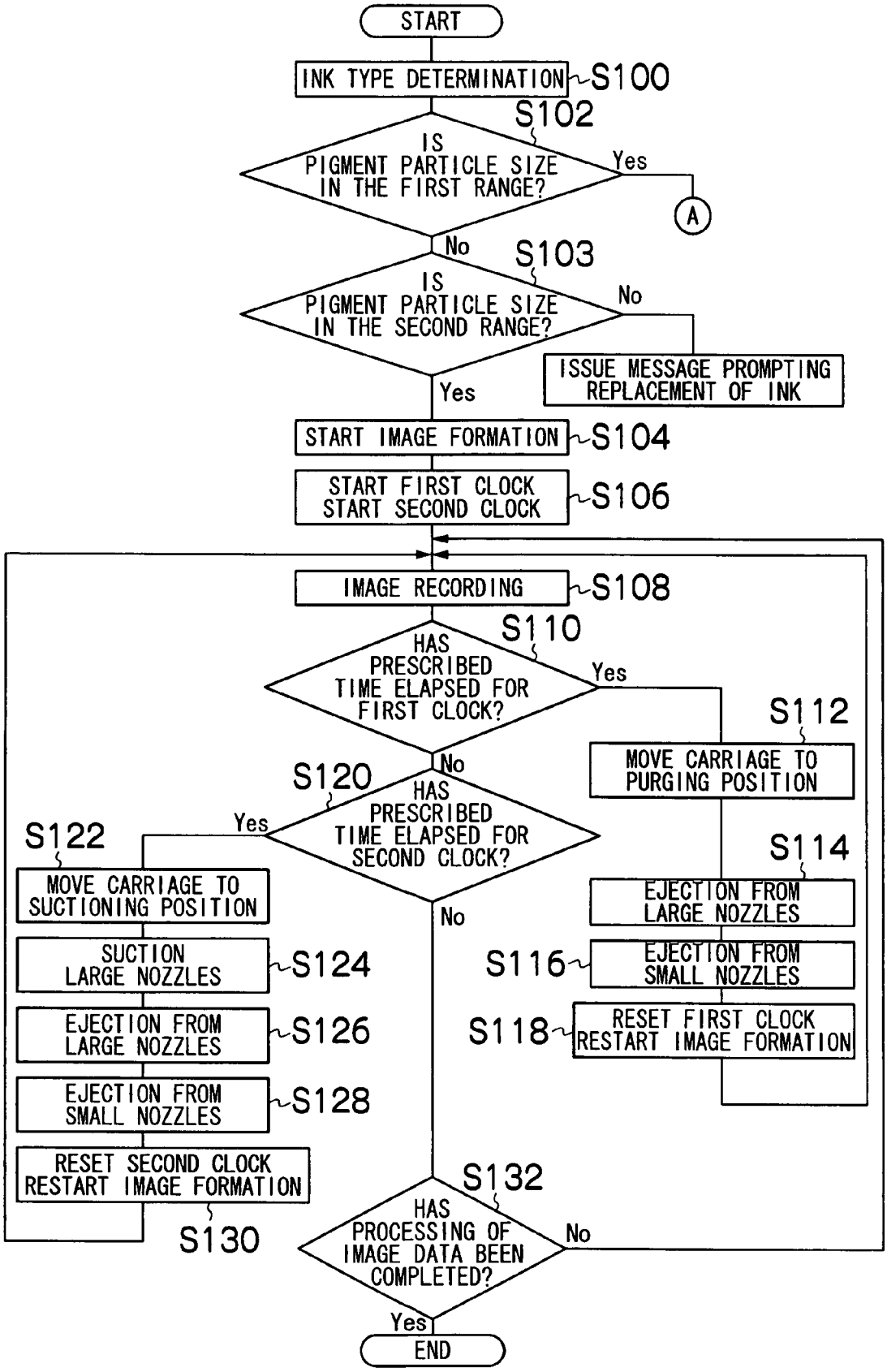
FIG. 14 is a flowchart showing preliminary ejection control in a case of a relatively large pigment particle size, which illustrates actions of the inkjet recording apparatus according to an embodiment of the present invention.

FIG. 14 shows the overall control of purging and preliminary ejection in the present embodiment, and control in the case of a large pigment particle size, in particular. Moreover, FIG. 15 shows control of the purging and preliminary ejection according to the present embodiment in the case of a small pigment particle size.

Firstly, at step S100 in FIG. 14, the ink type used in the inkjet recording apparatus 100 is determined. This is performed by the ink type determination unit 39. The ink type thus determined is sent to the system controller 72, and the pigment particle size distribution is judged.

Next, at step S102, it is judged whether or not this pigment particle size distribution is within a first range. This involves judging whether or not the pigment particles having a size equal to or greater than 110 nm account for not more than 5 vol % (volume percent). If these conditions are satisfied, then there is not a large presence of pigment particles having a particle size of 110 nm or greater, and virtually all of the pigment-based particles have a size that is smaller than 110 nm. In this case, the pigment ink is one having a very fine pigment particle size. In cases such as this, the procedure advances to the flowchart in FIG. 8, as indicated by the reference symbol A. The processing carried out in the case of a small pigment particle size is described hereinafter.

If the pigment particle size is not within the first range according to the judgment in step S102, in other words, if the ratio of pigment particles having a particle size equal to or greater than 110 nm is greater than 5 vol %, then at the next step, S103, it is judged whether or not the pigment particle size is within a second range. This involves judging whether or not the ratio of pigment particles having a particle size equal to or greater than 110 nm is greater than 5 vol %, and furthermore, whether or not the ratio of pigment particles having a particle size equal to or greater than 150 nm is equal to or less than 5 vol %. If the pigment particle size is within the second range, then this means that although the ratio of pigment particles having a particle size equal to or greater than 110 nm is greater than 5 vol %, almost all of these particles are in a size range equal to or less than 150 nm. Furthermore, in the case of an ink which does not comply with either the first range or the second range, in other words, an ink in which the pigment particles having a particle size exceeding 150 nm account for 5 vol % or more of the pigment, a warning is issued to indicate that there is a possibility that ejection failures may occur, or a possibility that the printing quality may decline, and the user is prompted to change the ink to one which complies with either the first range or the second range.

If the pigment particle size lies in the second range, then ejection is controlled in such a manner that during purging or preliminary ejection, the large nozzles perform ejection a greater number of times than the small nozzles, or the large nozzles perform ejection before the small nozzles. The example described below with reference to FIG. 12 is an example of control in which the large nozzles perform ejection before small nozzles in the preliminary ejection.

If the pigment particle size lies in the second range, in other words, if the ratio of the pigment particles having a particle size equal to or greater than 110 nm is greater than 5 vol %, and if the ratio of pigment particles having a particle size equal to or greater than 150 nm is equal to or less than 5 vol %, then firstly, at step S104, image formation is started. After starting image formation, at step S106, a first clock and a second clock are started. Here, the first clock serves to control the timing of the preliminary ejection (purging), and the second clock serves to control the timing of the preliminary ejection after suctioning.

Thereupon, an image is output (image recording is carried out), at the step S108. In this, an image is formed by ejecting pigment-based inks respectively onto the recording paper 10, from the heads 12Y, 12C, 12M and 12K of the respective colors, while moving the recording heads 12 reciprocally back and forth in the main scanning direction, which is a substantially perpendicular direction with respect to the conveyance direction of the recording paper 10 (sub-scanning direction), by driving the carriage 22 by means of the main scanning motor 32. In this case, as stated previously, it is possible to record images by performing the scanning (the head movement) in one direction only, or it is possible to record images by performing the scanning in both directions.

While image recording is carried out in this way, in the subsequent step S110, it is judged whether or not the first clock which controls the preliminary ejection timing during recording has passed a prescribed period of time. If the first clock has passed the prescribed time period, then even during recording of an image onto a sheet of recording paper 10, the image recording is interrupted, and at the next step S12, the carriage 22 is moved to a purging position. For example, the carriage 22 is moved to the position of the purge receptacle 34 provided on the left-hand side of the direction of conveyance of the recording paper 10 in FIG. 10. However, in this case, if the carriage 22 is positioned to the right-hand side of the center in the breadthways direction of the recording paper 10 in FIG. 10, then it is also possible to move the carriage 22 toward the purge receptacle 36 on the right-hand side.

Thereupon, purging is carried out, by firstly performing the ejection from the large nozzles 42 toward the purge receptacle 34 (or purge receptacle 36) at step S14, and then performing the ejection from the small nozzles 44 in the next step S116.

After preliminary ejection has been completed from the large nozzles 42 and the small nozzles 44, at the next step, S118, the first clock is reset, the carriage 22 is returned to the position at which image recording has been interrupted, and the procedure returns to step S108, where image formation is restarted.

Moreover, at step S110, if it is judged that the first clock has not yet reached the prescribed time period (after reset), then the procedure advances to the next step, S120 where it is judged whether the second clock which controls the preliminary ejection timing after suctioning has passed a prescribed time period or not.

At step S120, if the second clock has passed the prescribed time period, then the procedure advances to step S122, the image recording is interrupted, and the carriage 22 is moved to a suctioning position where the purge receptacle 36 shown in FIG. 10 is disposed. Thereupon, at the next step, S124, a purge receptacle (cap) 36 is placed in close contact with the recording head 12 (head 50), the suction pump 67 is driven, and the ink inside the large nozzles 42 and the small nozzles 44 is suctioned.

Thereupon, at step S126, the large nozzles 42 perform ejection toward the purge receptacle 36, whereupon at step S128, the small nozzles 44 perform ejection toward the purge receptacle 36, in a similar manner.

The second clock is reset at step S130, the carriage 22 is returned to the position where the image recording has been interrupted, and the procedure then reverts to the step S108 and image recording is restarted.

In this way, image recording is continued while repeating a "purging" and a combination of "suctioning and purging" performed during image recording, and when the image data ends at step S132, image recording terminates.

Furthermore, it is desirable that preliminary ejection control should be carried out in such a manner that the ejection volume from the large nozzles 42 is greater than the ejection volume from the small nozzles 44, not only in the case of preliminary ejection after suctioning, but also in the case where preliminary ejection is performed from the large nozzles 42 and the small nozzles 44 during image recording. By raising the ejection volume from the large nozzles 42, great beneficial effects are obtained not only in respect of preventing floating mist or shortening of the preliminary ejection time, but also in respect of stabilizing ejection and suppressing ejection failures. Since the large nozzles 42 and the small nozzles 44 receive a supply of ink from the same common liquid chamber 40 (55), then by increasing the preliminary ejection volume from the large nozzles 42, it is possible to eject (expel) the old ink inside the common liquid chamber 40 (55), effectively, and therefore it is possible to improve the ejection characteristics of the small nozzles 44 in particular.

Ejection can be controlled in such a manner that the number of ejections from the large nozzles 42 during preliminary ejection (namely, the number of ejections performed from one large nozzle 42), is greater than the number of ejections from the small nozzles 44 (namely, the number of ejections performed from one small nozzle 44). For example, if one large nozzle 42 performs ejection 100 times, then one small nozzle 44 may be made to perform ejection 50 times. By this means, it is possible to make the ejection volume from the large nozzles 42 greater than the ejection volume from the small nozzles 44.

Furthermore, desirably, it is also possible to make the ejection frequency from the large nozzles 42 during the preliminary ejection higher than the ejection frequency of the small nozzles 44. For example, by making the ejection frequency from the large nozzles 42 approximately two to four times higher than the ejection frequency from the small nozzles 44, it is possible to eject the old ink inside the common liquid chamber 40 (55), effectively in large volume, from the large nozzles 42, and therefore ejection stability can be improved.

There follows a description of the ejection control in a case where the pigment particle size is in the first range. If it is judged, at step S102 in FIG. 14, that the pigment particle size is in the first range, in other words, the ratio of particles having a particle size equal to or greater than 110 nm is equal to or less than 5 vol %, then the processing in flowchart in FIG. 15 is carried out.

Figure 15:
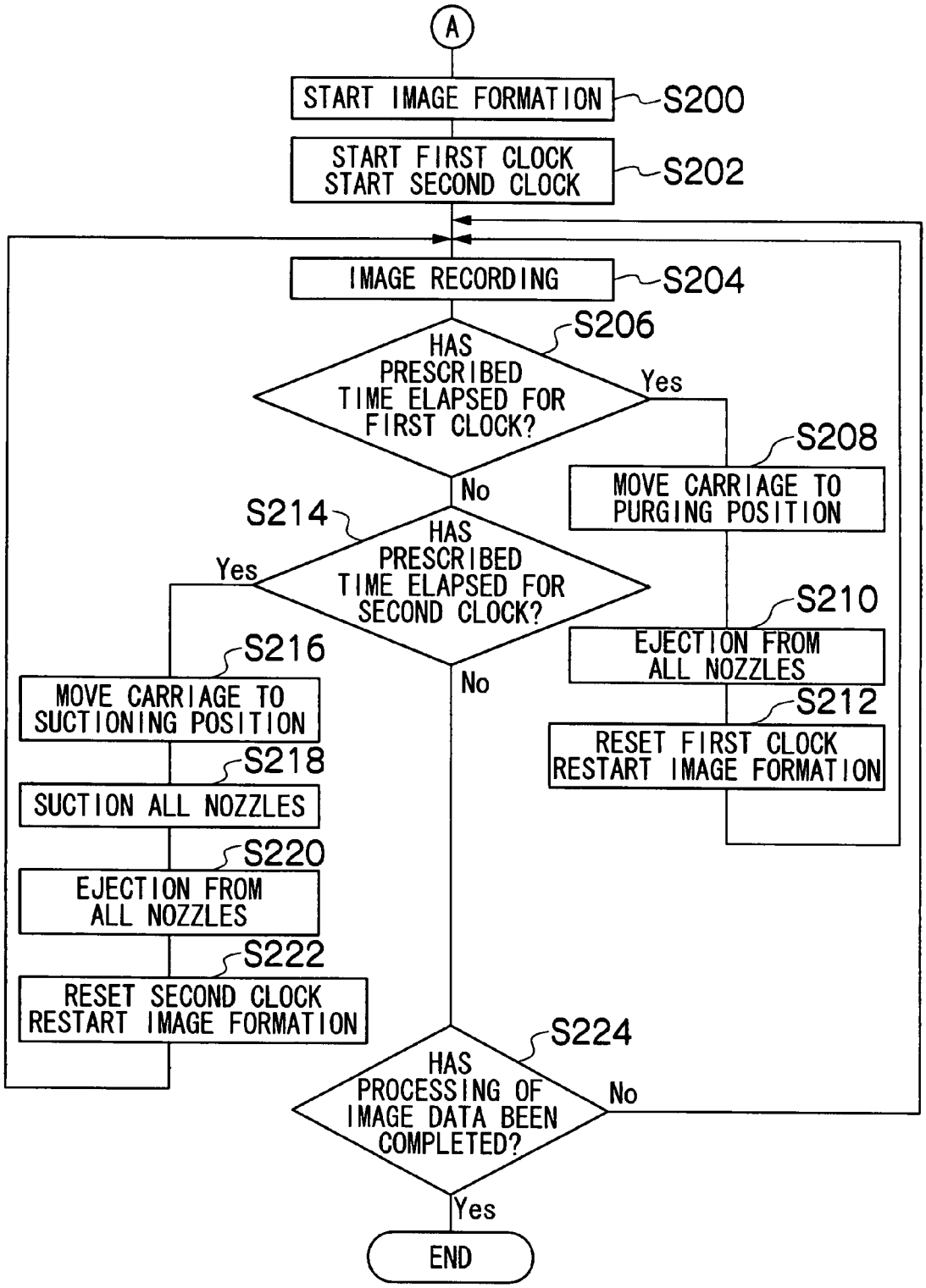
FIG. 15 is a flowchart showing preliminary ejection control in a case of a very fine pigment particle size, which illustrates actions of the inkjet recording apparatus according to an embodiment of the present invention.

The ejection control in FIG. 15 involves processing in respect of ink which has very fine pigment particle size and approximates a dye-based ink. In this case, as described below, purging or preliminary ejection is carried out from the large and small nozzles, simultaneously.

Firstly, image formation is started at step S200 in FIG. 15. After starting image formation, at step S202, a first clock and a second clock are started. Here, the meanings of the first clock and the second clock are the same as those in the control sequence shown in FIG. 9. In other words, the first clock serves to control the timing of the preliminary ejection, and the second clock serves to control the timing of the preliminary ejection after suctioning.

Thereupon, image recording is carried out at the step S204. While performing the image recording, at the next step, S206, it is judged whether or not the first clock has passed a prescribed period of time. If the first clock has passed the prescribed period of time, then the image recording is interrupted, and at the next step, S208, the carriage 22 is moved to a purging position (the purge receptacle 34 or 36).

At the next step, S210, ejection is performed simultaneously from the large nozzles 42 and the small nozzles 44, toward the purge receptacle 34 or 36. In other words, preliminary ejection is carried out by performing the ejection from all of the nozzles simultaneously.

Thereupon, at step S212, the first clock is reset, the carriage 22 is returned to the position where the image recording has been interrupted, and the procedure then reverts to step S204 and image formation is restarted.

Moreover, at step S206, if it is judged that the first clock has not yet reached the prescribed time period (after reset), then the procedure advances to the next step, S214, where it is judged whether or not the second clock has passed a prescribed time period.

At step S214, if the second clock has passed the prescribed time period, then the procedure advances to step S216, the image recording is interrupted, and the carriage 22 is moved to the position where the purge receptacle 36 shown in FIG. 10 is disposed. Thereupon, at the next step, S218, a purge receptacle (cap) 36 is placed in close contact with the recording head 12 (head 50), the suction pump 67 is driven, and the ink inside the large nozzles 42 and the small nozzles 44, namely, all of the nozzles, is suctioned.

Next, at step S220, ejection is performed from the large nozzles 42 and the small nozzles 44, namely, from all of the nozzles, toward the purge receptacle 36. At step S222, the second clock is reset, the carriage 22 is returned to the position where the image recording has been interrupted, and the procedure then reverts to the step S204 and image recording is restarted.

In this way, image recording is continued while repeating "purging" and "a combination of suctioning and purging" performed during image recording, and when it is judged that the image data has ended at step S224, then the image recording terminates.

As described above, in the present embodiment, control is implemented in such a manner that if ink which has a very fine particle size of the pigment particles (a pigment particle size in the first range) and ink which has a relatively large pigment particle size (a pigment particle size in the second range) are both present, then in the case of the ink having relatively large pigment particle size, ejections are performed from the large nozzles before ejections of the small nozzles, for example, whereas in the case of the ink of very fine particle size, purging is carried out simultaneously from both the large and small nozzles. By this means, it is possible to improve ejection stability and prevent ejection failures, efficiently, and hence to achieve stable, high-quality printing, and ensure good reliability.

Image recording methods and image recording apparatuses according to the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising a recording head including:

large nozzles which eject ink containing pigment particles serving as a coloring material;

small nozzles which eject the ink; and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium;

of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that number of ejections of the ink from the large nozzles is greater than number of ejections of the ink from the small nozzles.

2. The inkjet recording apparatus as defined in claim 1, further comprising a suctioning device which is provided at a particular position outside the region for the image recording and forcibly suctions the ink inside the recording head, wherein, after the suctioning device suctions the ink inside the recording head, the large nozzles and the small nozzles eject the ink that is unrelated to the image recording.

3. An inkjet recording apparatus comprising a recording head including:

large nozzles which eject ink containing pigment particles serving as a coloring material;

small nozzles which eject the ink; and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium;

of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that the large nozzles eject the ink that is unrelated to the image recording before the small nozzles eject the ink that is unrelated to the image recording.

4. The inkjet recording apparatus as defined in claim 3, further comprising a suctioning device which is provided at a particular position outside the region for the image recording and forcibly suctions the ink inside the recording head, wherein, after the suctioning device suctions the ink inside the recording head, the large nozzles and the small nozzles eject the ink that is unrelated to the image recording.

5. An inkjet recording apparatus comprising a recording head including:

large nozzles which eject ink containing pigment particles serving as a coloring material;

small nozzles which eject the ink; and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium;

of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that a frequency of ejections of the ink from the large nozzles is higher than a frequency of ejections of the ink from the small nozzles.

6. The inkjet recording apparatus as defined in claim 5, further comprising a suctioning device which is provided at a particular position outside the region for the image recording and forcibly suctions the ink inside the recording head, wherein, after the suctioning device suctions the ink inside the recording head, the large nozzles and the small nozzles eject the ink that is unrelated to the image recording.

7. An inkjet recording method comprising the step of moving a recording head including large nozzles which eject ink containing pigment particles serving as a coloring material, small nozzles which eject the ink, and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium;

of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that number of ejections of the ink from the large nozzles is greater than number of ejections of the ink from the small nozzles.

8. The inkjet recording method as defined in claim 7, wherein, after the ink inside the recording head is suctioned forcibly at a particular position outside the region for the image recording, the large nozzles and the small nozzles eject the ink that is unrelated to the image recording.

9. An inkjet recording method comprising the step of moving a recording head including large nozzles which eject ink containing pigment particles serving as a coloring material, small nozzles which eject the ink, and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium;

of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that the large nozzles eject the ink that is unrelated to the image recording before the small nozzles eject the ink that is unrelated to the image recording.

10. The inkjet recording method as defined in claim 9, wherein, after the ink inside the recording head is suctioned forcibly at a particular position outside the region for the image recording, the large nozzles and the small nozzles eject the ink that is unrelated to the image recording.

11. An inkjet recording method comprising the step of moving a recording head including large nozzles which eject ink containing pigment particles serving as a coloring material, small nozzles which eject the ink, and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium;

of the pigment particles which are dispersed in the ink, the pigment particles having a particle diameter not less than 150 nm account for not more than 5 volume percent; and an ink ejection process in which the large nozzles and the small nozzles eject the ink that is unrelated to the image recording is performed at a particular timing in a process of the image recording and at a particular position outside a region for the image recording in such a manner that a frequency of ejections of the ink from the large nozzles is higher than a frequency of ejections of the ink from the small nozzles.

12. The inkjet recording method as defined in claim 11, wherein, after the ink inside the recording head is suctioned forcibly at a particular position outside the region for the image recording, the large nozzles and the small nozzles eject the ink that is unrelated to the image recording.

13. An inkjet recording apparatus comprising:

a recording head including large nozzles which eject ink containing pigment particles serving as a coloring material, small nozzles which eject the ink, and a common ink flow channel which is connected to the large nozzles and the small nozzles; and an ink type determination unit which determines a type of the ink, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium; and when an ink ejection process in which the large nozzles and the small nozzles eject the ink that is unrelated to the image recording is performed at a particular timing in a process of the image recording and at a particular position outside a region for the image recording, ejections of the ink from the large nozzles and ejections of the ink from the small nozzles are controlled in such a manner that at least one of number of ejections of the ink from the large nozzles, number of ejections of the ink from the small nozzles, sequence of the ejections of the ink from the large nozzles and the small nozzles, and a frequency of the ejections of the ink from the large nozzles and the small nozzles is adjusted in accordance with the type of the ink determined by the ink type determination unit.

14. The inkjet recording apparatus as defined in claim 13, wherein:

the type of the ink determined by the ink type determination unit is categorized according to particle size distribution of the pigment particles which are contained in the ink and serve as a coloring material; and when the ink ejection process in which the large nozzles and the small nozzles eject the ink that is unrelated to the image recording is performed at the particular timing in the process of the image recording and at the particular position outside the region for the image recording, at least one of the number of ejections of the ink from the large nozzles, the number of ejections of the ink from the small nozzles, the sequence of the ejections of the ink from the large nozzles and the small nozzles, and the frequency of the ejections of the ink from the large nozzles and the small nozzles is adjusted in accordance with the particle size distribution of the pigment particles.

15. The inkjet recording apparatus as defined in claim 13, wherein, when the ink ejection process in which the large nozzles and the small nozzles eject the ink that is unrelated to the image recording is performed at the particular timing in the process of the image recording and at the particular position outside the region for the image recording, in a case where the pigment particles having a particle diameter of not less than 110 nm account for not more than 5 volume percent of the pigment particles dispersed in the ink, the ejections of the ink from the large nozzles and the ejections of the ink from the small nozzles are performed simultaneously, and in a case where the pigment particles having a particle diameter of not less than 110 nm account for more than 5 volume percent of the pigment particles dispersed in the ink and the pigment particles having a particle diameter of not less than 150 nm is not more than 5 volume percent of the pigment particles dispersed in the ink, the ejections of the ink from the large nozzles and the ejections of the ink from the small nozzles are controlled in accordance with at least one of following manners:

a manner in which the number of ejections of the ink from the large nozzles is greater than the number of ejections of the ink from the small nozzles;

a manner in which the large nozzles eject the ink that is unrelated to the image recording before the small nozzles eject the ink that is unrelated to the image recording; and a manner in which the frequency of ejections of the ink from the large nozzles is higher than the frequency of ejections of the ink from the small nozzles.

16. An inkjet recording method comprising the step of moving a recording head including large nozzles which eject ink containing pigment particles serving as a coloring material, small nozzles which eject the ink, and a common ink flow channel which is connected to the large nozzles and the small nozzles, wherein:

a volume of the ink ejected from each of the large nozzles is different from a volume of the ink ejected from each of the small nozzles;

the large nozzles and the small nozzles eject the ink to perform image recording on a recording medium in terms of one direction or both directions while the recording head is moved bi-directionally in a direction substantially perpendicular to a conveyance direction of the recording medium; and when an ink ejection process in which the large nozzles and the small nozzles eject the ink that is unrelated to the image recording is performed at a particular timing in a process of the image recording and at a particular position outside a region for the image recording, a type of the ink determined is determined and ejections of the ink from the large nozzles and ejections of the ink from the small nozzles are controlled in such a manner that at least one of number of ejections of the ink from the large nozzles, number of ejections of the ink from the small nozzles, sequence of the ejections of the ink from the large nozzles and the small nozzles, and a frequency of the ejections of the ink from the large nozzles and the small nozzles is adjusted in accordance with the determined type of the ink.

17. The inkjet recording method as defined in claim 16, wherein:

the type of the ink is categorized according to particle size distribution of the pigment particles which are contained in the ink and serve as a coloring material; and when the ink ejection process in which the large nozzles and the small nozzles eject the ink that is unrelated to the image recording is performed at the particular timing in the process of the image recording and at the particular position outside the region for the image recording, at least one of the number of ejections of the ink from the large nozzles, the number of ejections of the ink from the small nozzles, the sequence of the ejections of the ink from the large nozzles and the small nozzles, and the frequency of the ejections of the ink from the large nozzles and the small nozzles is adjusted in accordance with the particle size distribution of the pigment particles.

18. The inkjet recording method as defined in claim 16, wherein, when the ink ejection process in which the large nozzles and the small nozzles eject the ink that is unrelated to the image recording is performed at the particular timing in the process of the image recording and at the particular position outside the region for the image recording, in a case where the pigment particles having a particle diameter of not less than 110 nm account for not more than 5 volume percent of the pigment particles dispersed in the ink, the ejections of the ink from the large nozzles and the ejections of the ink from the small nozzles are performed simultaneously, and in a case where the pigment particles having a particle diameter of not less than 110 nm account for more than 5 volume percent of the pigment particles dispersed in the ink and the pigment particles having a particle diameter of not less than 150 nm is not more than 5 volume percent of the pigment particles dispersed in the ink, the ejections of the ink from the large nozzles and the ejections of the ink from the small nozzles are controlled in accordance with at least one of following manners:

a manner in which the number of ejections of the ink from the large nozzles is greater than the number of ejections of the ink from the small nozzles;

a manner in which the large nozzles eject the ink that is unrelated to the image recording before the small nozzles eject the ink that is unrelated to the image recording; and a manner in which the frequency of ejections of the ink from the large nozzles is higher than the frequency of ejections of the ink from the small nozzles.

* * * * *